US007556178B2

(12) United States Patent
Ophardt

(10) Patent No.: US 7,556,178 B2
(45) Date of Patent: Jul. 7, 2009

(54) ONE-WAY VALVE AND VACUUM RELIEF DEVICE

(75) Inventor: Heiner Ophardt, Vineland (CA)

(73) Assignee: Hygiene-Technik Inc., Beamsville, Ontario (CA)

( * ) Notice: Subject to any disclaimer, the term of this patent is extended or adjusted under 35 U.S.C. 154(b) by 640 days.

(21) Appl. No.: 11/085,048

(22) Filed: Mar. 22, 2005

(65) Prior Publication Data

US 2005/0161476 A1 Jul. 28, 2005

Related U.S. Application Data

(63) Continuation-in-part of application No. 10/983,574, filed on Nov. 9, 2004, which is a continuation of application No. 10/132,321, filed on Apr. 26, 2002, now Pat. No. 6,957,751.

(30) Foreign Application Priority Data

Apr. 27, 2004 (CA) ..... 2465468

(51) Int. Cl.
*B67D 5/06* (2006.01)
*B65D 37/00* (2006.01)

(52) U.S. Cl. ..... 222/205; 222/185.1; 222/212; 222/188

(58) Field of Classification Search ..... 222/185.1, 222/188, 181.1, 181.2, 205, 481.5, 484, 478, 222/457, 442, 321.7, 321.8, 321.9, 207, 212, 222/587

See application file for complete search history.

(56) References Cited

U.S. PATENT DOCUMENTS 517,305 A 3/1894 Schlueter
878,750 A 2/1908 Schmidt
1,228,836 A 6/1917 Schulse
1,236,912 A 8/1917 Cooper
1,319,376 A 10/1919 Cooper
1,886,288 A 11/1932 Everett
2,387,922 A 10/1945 McBrien
2,949,212 A 8/1960 Watson
4,324,349 A 4/1982 Kaufman
4,930,668 A 6/1990 Krall (Continued)

FOREIGN PATENT DOCUMENTS

EP 0 381 884 A 8/1990

(Continued)

*Primary Examiner*—Kevin P Shaver
*Assistant Examiner*—Stephanie E Tyler
(74) *Attorney, Agent, or Firm*—Riches, McKenzie & Herbert LLP

(57) ABSTRACT

Liquid dispensers are provided including a vacuum relief mechanism with a vacuum relief device and a one-way valve in series with the vacuum relief device to prevent flow into and out of the reservoir when a vacuum exists in the reservoir. The vacuum relief device comprises an enclosed chamber having an air inlet open to the atmosphere and a liquid inlet in communication with liquid in the reservoir and in which the liquid inlet opens to the chamber at a height below a height at which the air inlet opens to the chamber. The one-way valve is capable of failure, in which case the vacuum relief device alone provides for pressure relief. The vacuum relief valve permits relief of vacuum from the reservoir without moving parts or valves.

20 Claims, 19 Drawing Sheets

U.S. PATENT DOCUMENTS

| | | | |
|---|---|---|---|
| 5,165,577 | A | 11/1992 | Ophardt |
| 5,282,552 | A | 2/1994 | Ophardt |
| 5,329,117 | A | 7/1994 | Galili |
| D350,665 | S | 9/1994 | Ophardt |
| 5,373,970 | A | 12/1994 | Ophardt |
| 5,427,279 | A | 6/1995 | Kaufman |
| 5,431,309 | A | 7/1995 | Ophardt |
| 5,489,044 | A | 2/1996 | Ophardt |
| D378,035 | S | 2/1997 | Ophardt |
| 5,676,277 | A | 10/1997 | Ophardt |
| 5,836,482 | A | 11/1998 | Ophardt |
| 5,904,272 | A | 5/1999 | Kaufman |
| 5,960,991 | A | 10/1999 | Ophardt |
| 5,975,360 | A | 11/1999 | Ophardt |
| 6,119,901 | A | 9/2000 | Hanna |
| 6,206,238 | B1 | 3/2001 | Ophardt |
| 6,343,724 | B1 | 2/2002 | Ophardt |
| 6,386,390 | B1 | 5/2002 | Tinker |
| 6,390,329 | B1 | 5/2002 | Maddox |
| 6,467,651 | B1 | 10/2002 | Muderlak |

FOREIGN PATENT DOCUMENTS

| | | | |
|---|---|---|---|
| FR | 1 039 725 | A | 10/1953 |
| GB | 1386152 | | 3/1972 |
| GB | 2391221 | A | 4/2003 |
| WO | WO 81/01993 | | 7/1981 |

ONE-WAY VALVE AND VACUUM RELIEF DEVICE

SCOPE OF THE INVENTION

This invention relates to a vacuum relief device and, more particularly, to a vacuum relief mechanism for relieving vacuum developed within a fluid containing reservoir. This application is a continuation-in-part of U.S. application Ser. No. 10/983,574 filed Nov. 9, 2004, which is a continuation of U.S. application Ser. No. 10/132,321 filed Apr. 26, 2002 now U.S. Pat. No. 6,957,751.

BACKGROUND OF THE INVENTION

Arrangements are well known by which fluid is dispensed from fluid containing reservoirs. For example, known hand soap dispensing systems provide reservoirs containing liquid soap from which soap is to be dispensed. When the reservoir is enclosed and rigid so as to not be collapsible then, on dispensing liquid soap from the reservoir, a vacuum comes to be created in the reservoir. It is known to provide one-way valves which permit atmospheric air to enter the reservoir and permit the vacuum in the reservoir to be reduced. The one-way valves typically operate such that the one-way valve prevents air from entering the reservoir unless a vacuum is developed to a certain level below atmospheric pressure. To the extent that the vacuum increases beyond this certain level, then the valve will open permitting air to enter the reservoir and thereby prevent the vacuum from increasing further.

The provision of vacuum relief valves is advantageous not only in enclosed reservoirs which are rigid but also with reservoirs that may not so readily collapse as to prevent the development of a vacuum within the reservoir on dispensing.

The present inventor has appreciated that reducing the ability of vacuum conditions to arise in any reservoir can be advantageous so as to facilitate dispensing of fluid from the reservoir, particularly so as to permit dispensing with a minimal of effort and with a pump which has minimal ability to overcome any vacuum pressure differential to atmospheric pressure.

U.S. Pat. No. 5,676,277 to Ophardt which issued Oct. 14, 1997 discloses in FIG. 10 a known one-way valve structure in which a resilient flexible seal member is biased to close an air passageway such that on the development of vacuum within a reservoir, the seal member is deflected out of a position to close the air passageway and permits atmospheric air to enter the reservoir relieving the vacuum. Such flexible seal members suffer the disadvantage that they are subject to failure, do not always provide a suitable seal, and to be flexible must frequently be made from different materials than the remainder of the value structure. As well as insofar as a flexible seal member is to be maintained in contact with fluid from the reservoir, then difficulties may arise in respect of degradation of the flexible sealing member with time. As well, the flexible sealing member typically must experience some minimal level of vacuum in order to operate and such minimal level of vacuum can, in itself, at times present difficulty in dispensing fluid from the reservoir.

SUMMARY OF THE INVENTION

To at least partially overcome these disadvantages of previously known devices, the present invention provides a vacuum relief valve which comprises an enclosed chamber having an air inlet open to the atmosphere and a liquid inlet in communication with liquid in the reservoir and in which the liquid inlet opens to the chamber at a height below a height at which the air inlet opens to the chamber.

An object of the present invention is to provide a simplified vacuum relief device, preferably for use with an enclosed reservoir in a fluid dispensing application.

Another object is to provide a vacuum relief device without moving parts.

Another object is to provide a vacuum relief device as part of a disposable plastic liquid pump.

Another object is to provide a liquid dispenser which is substantially drip proof.

Another object is to provide a simple dispenser in which a vacuum relief device for relieving vacuum in a reservoir also permits dispensing of liquid therethrough when the reservoir is pressurized.

Another object is to provide in combination with a one-way valve with a resilient seal member a vacuum relief device which is operative for vacuum relief should the one-way valve fail.

Accordingly, in one aspect, the present invention provides a vacuum relief mechanism adapted to permit atmospheric air to enter a liquid containing reservoir to reduce vacuum developed in the reservoir, the mechanism comprising a vacuum relief device and a one-way valve, the vacuum relief device comprising:

an enclosed chamber having an air inlet and a liquid inlet, the air inlet in communication with air at atmospheric pressure, the liquid inlet in communication with liquid in the reservoir, the liquid inlet open to the chamber at a height which is below a height at which the air inlet is open to the chamber, the one-way valve disposed between the liquid inlet and the reservoir movable between a closed position preventing flow between the reservoir and the liquid inlet and an open position permitting flow through the valve, the valve biased to assume the closed position.

In another aspect, the present invention provides in combination, an enclosed liquid containing reservoir, a pump and a vacuum relief mechanism, the vacuum relief mechanism comprising a vacuum relief device and a one-way valve, the reservoir having a liquid outlet connected with the pump which is operable to draw liquid from the reservoir via the liquid outlet, a vacuum below atmospheric pressure is developed within the reservoir on drawing liquid from the reservoir via the pump, the vacuum relief device is adapted to permit atmospheric air to enter the reservoir via the liquid outlet to reduce any vacuum developed in the reservoir, the vacuum relief device comprising an enclosed chamber having an air inlet and a liquid inlet, the liquid inlet open to the chamber at a height which is below a height at which the air inlet is open to the chamber, the air inlet in communication with air at atmospheric pressure such that the chamber is at atmospheric pressure, the liquid inlet connected by via a liquid passageway with the liquid outlet, the one-way valve disposed between the liquid inlet and the reservoir movable between a closed position preventing flow between the reservoir and the liquid inlet and an open position permitting flow through the valve, the valve biased to the closed position, the liquid inlet at a height below a height of liquid in the reservoir.

A vacuum relief mechanism in accordance with the present invention is adapted for use in a number of different embodiments of fluid reservoirs and dispensers. It can be formed to be compact so as to be a removable plastic compartment as, for example, adapted to fit inside the neck of a bottle as, for example, part of and inwardly from a pump assembly forming a plug for a bottle.

The vacuum relief mechanism may be used not only to relieve vacuum pressure in a reservoir but also for dispensing liquid therethrough, as by a pump drawing liquid out from a chamber in the vacuum relief valve.

The vacuum relief mechanism may be used to provide a dispenser which does not drip by having not only a one-way valve to reduce dripping but also a vacuum relief valve device with an air lock above the liquid level in the chamber in the vacuum relief device.

The vacuum relief valve may be configured to be closed to prevent liquid flow from a reservoir and to be opened for operation.

Liquid dispensers are provided including a vacuum relief mechanism with a vacuum relief device and a one-way valve in series with the vacuum relief device to prevent flow into and out of the reservoir when a vacuum exists in the reservoir. The vacuum relief device comprises an enclosed chamber having an air inlet open to the atmosphere and a liquid inlet in communication with liquid in the reservoir and in which the liquid inlet opens to the chamber at a height below a height at which the air inlet opens to the chamber. The one-way valve is capable of failure, in which case the vacuum relief device alone provides for pressure relief. The vacuum relief valve permits relief of vacuum from the reservoir without moving parts or valves.

BRIEF DESCRIPTION OF THE DRAWINGS

Further aspects and advantages of the invention will become apparent from the following description taken together with the accompanying drawings in which.

DETAILED DESCRIPTION OF THE DRAWINGS

Figure 1:
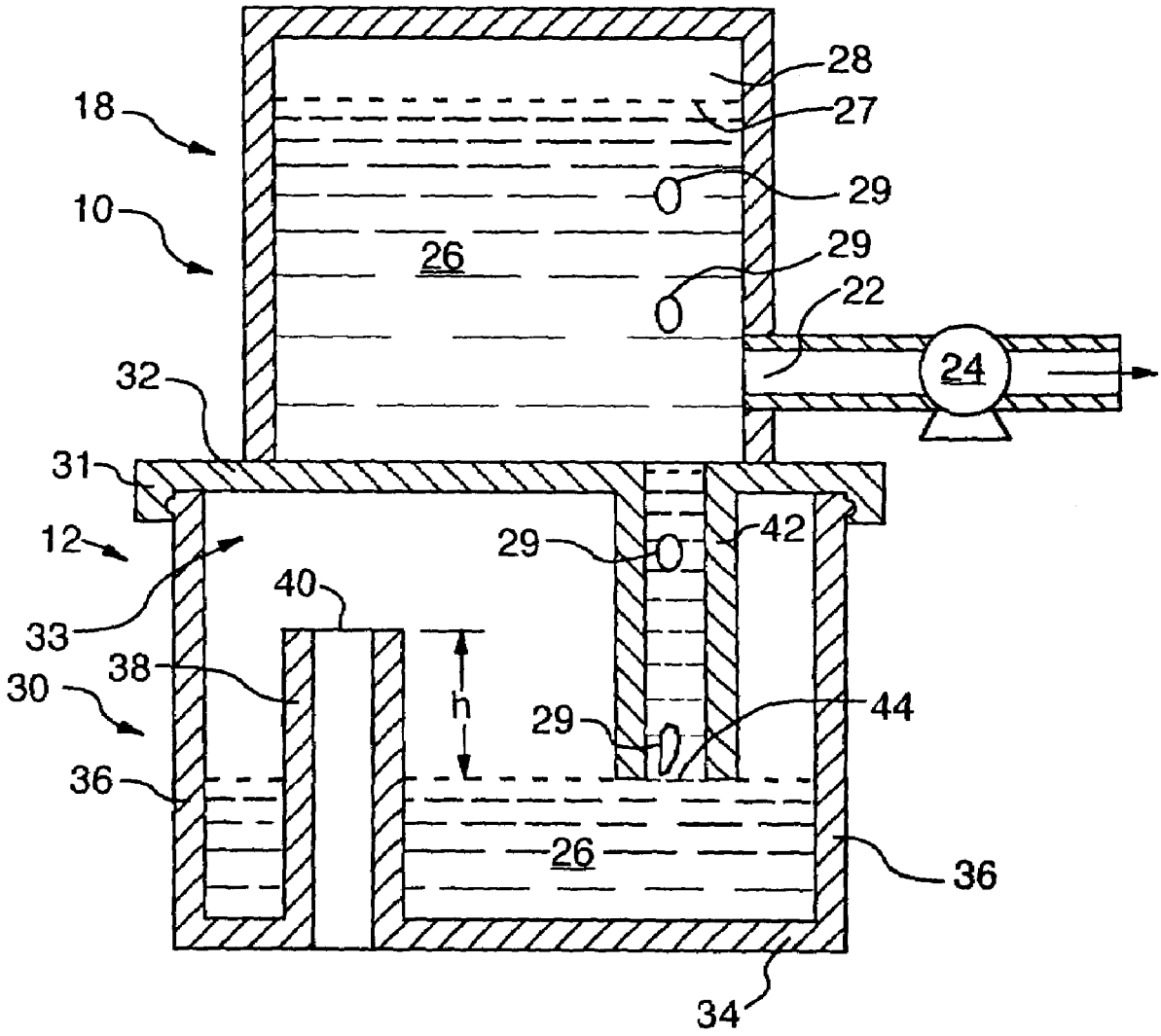
FIG. 1 is a schematic view of the soap dispenser incorporating a vacuum relief device in accordance with a first embodiment of the present invention illustrating a condition in which atmospheric air is passing into a reservoir.
Figure 2:
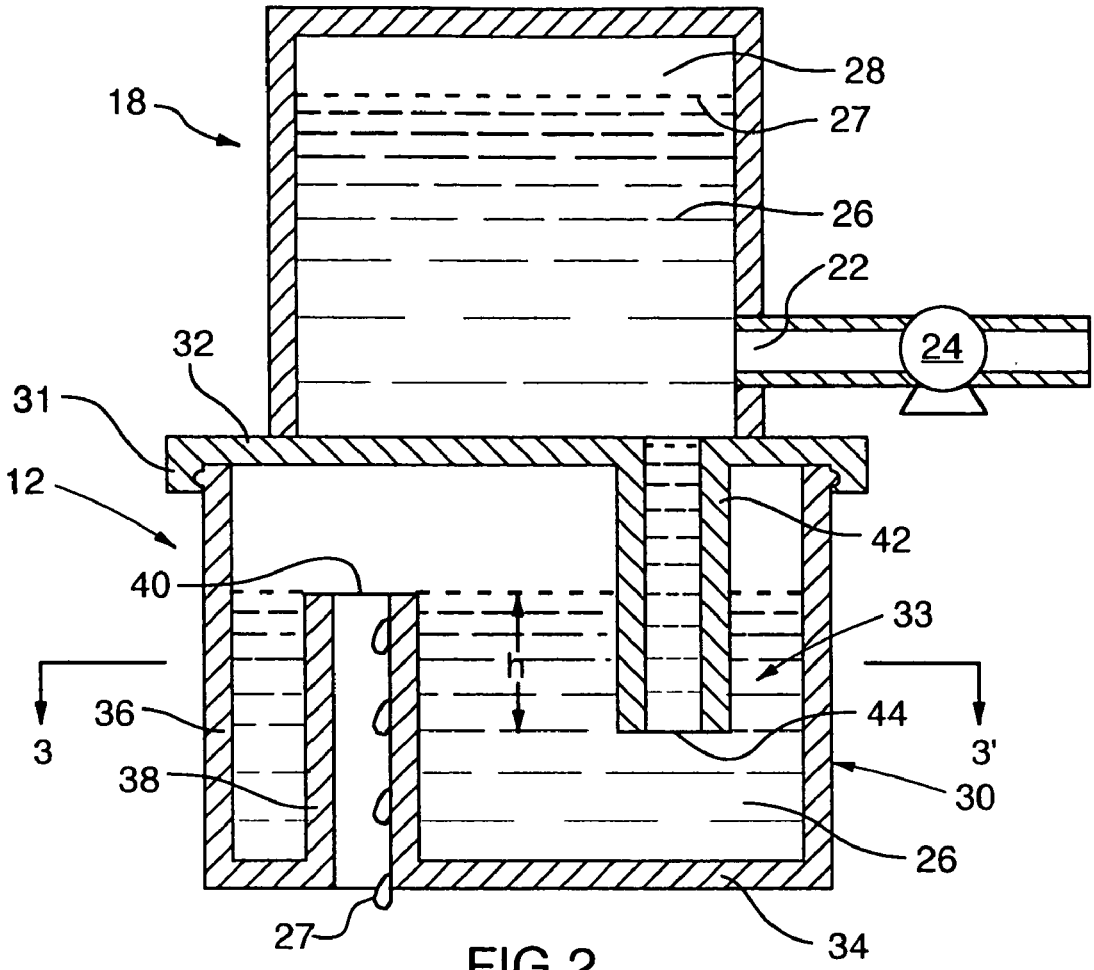
FIG. 2 is a schematic side view of the soap dispenser of FIG. 1, however, illustrating a condition in which liquid is at a position to flow from the vacuum relief device.
Figure 3:
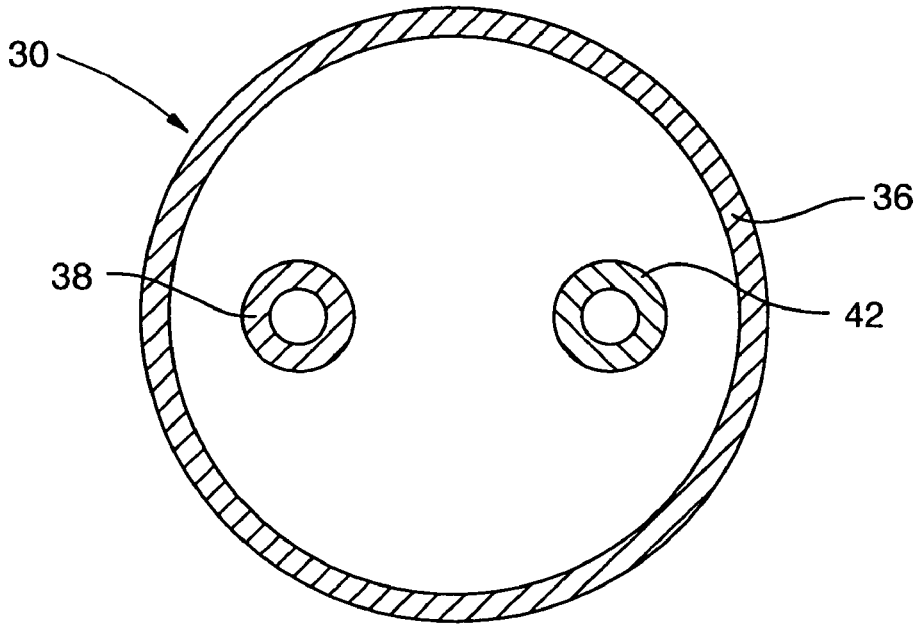
FIG. 3 is a cross-sectional view through the vacuum relief device of FIG. 1 along section lines 3-3'.

Reference is made first to FIGS. 1, 2 and 3 which schematically show, without regard to scale, a soap dispensing apparatus 10 incorporating a vacuum relief device 12 in accordance with the present invention. A reservoir 18 is shown schematically as comprising an enclosed non-collapsible reservoir having an outlet 22 in communication with a pump 24. The pump 24 is operative to dispense fluid 26 from the reservoir. The reservoir is shown to have fluid 26 in the lower portion of the reservoir with an upper surface 27 separating the fluid 26 from a pocket of air 28 within an upper portion of reservoir above the fluid 26.

The vacuum relief device 12 is illustrated as having a vessel including a base 30 and a cap 32 forming an enclosed chamber 33. As best seen in FIG. 3, the base 30 is cylindrical having a bottom wall 34 and a cylindrical upstanding side wall 36. The cap 32 is shown as having a cylindrical lip portion 31 adapted to secure the cap 32 to the upper edge of the cylindrical side wall 36 of the base forming a fluid tight seal therewith. A cylindrical air tube 38 extends upwardly from the base 30 to an air inlet 40. A liquid tube 42 extends downwardly from the cap 32 to a liquid inlet 44. As seen in both FIGS. 1 and 2, the vacuum relief device 12 is intended to be used in a vertical orientation as shown in the figures with the cap 32 at an upper position and the cylindrical side wall 36 oriented to extend vertically upwardly. As shown, the air inlet 40 opens into the chamber 33 at a height which is above a height at which the liquid inlet 44 opens into the chamber 33. The vertical distance between the air inlet 40 and the liquid inlet 44 is illustrated as being "h".

The vacuum relief device 12 is to be coupled to the reservoir 18 in a manner that the liquid inlet 44 is in communication via a liquid passageway passing through liquid tube 42 with the fluid 26 in the reservoir. For simplicity of illustration, the reservoir 18 is shown to have an open bottom which is in a sealed relation with the cap 32. The air inlet 40 is in communication via the air tube 38 with atmospheric air at atmospheric pressure.

Referring to FIG. 1, in the condition shown, the pump 24 has dispensed liquid from the reservoir such that the pressure in the reservoir 18 has been drawn below atmospheric pressure thus creating a vacuum in the reservoir. As a result of this vacuum, liquid 26 within the chamber 33 has been drawn upwardly from the chamber 33 through the liquid tube 42 into the reservoir 18. FIG. 1 illustrates a condition in which the vacuum which exists in the reservoir 18 is sufficient that the level of the liquid 26 in the chamber 33 has been drawn down to the height of the liquid inlet 44 and thus air which is within the chamber 33 above the liquid 26 in the chamber 33 comes to be at and below the height of the liquid inlet 44 and, thus, has entered the liquid tube 42 via the liquid inlet 44 and the air is moving as shown by air bubbles 29 under gravity upwardly through the fluid 26 in liquid tube 44 and reservoir 18 to come to form part of the air 28 in the top of the reservoir 18.

Since the air tube 38 is open to atmospheric air, atmospheric air is free to enter the chamber 33 via the air tube 38 and, hence, be available to enter the liquid tube 42.

Reference is made to FIG. 2 which is identical to FIG. 1, however, shows a condition in which the level of liquid 26 in the chamber 33 is just marginally above the height of the air inlet 40 and liquid 26 is flowing from the chamber 33 out the air tube 38 as shown by liquid droplets 27.

FIG. 2 illustrates a condition which is typically not desired to be achieved under normal operation of the fluid dispensing system of FIGS. 1 to 3. That is, the vacuum relief device 12 is preferably to be used as in the embodiment of FIGS. 1 to 3 in a manner to permit air to pass into the reservoir 18 as illustrated in FIG. 3 and it is desired to avoid a condition as shown in FIG. 2 in which fluid 26 will flow out of the air tube 38.

In the first embodiment of FIGS. 1 to 3, the air inlet 40 is desired to be at a height above the height to which the level of the liquid may, in normal operation, rise in the chamber 33. It is, therefore, a simple matter to determine this height and provide a height to the air inlet 40 which ensures that under reasonable operating conditions that the liquid will not be able to flow from the chamber 33 out the air tube 38.

Provided the fluid 26 fills the chamber 33 to or above the level of the liquid inlet 44, then air from the chamber 33 is prevented from accessing the liquid inlet 44 and cannot pass through the liquid tube 42 into the reservoir. The ability of liquid 26 to be dispensed out of the reservoir 18 by the pump 26 may possibly be limited to some extent to the degree to which a vacuum may exist in the reservoir. For vacuum to exist in the reservoir, there must be an expandable fluid in the reservoir such as air 28 or other gases above the liquid 26. At any time, the level of the liquid in the chamber 33 will be factor which will determine the amount of additional vacuum which must be created within the reservoir 18 in order for the level of liquid in the chamber 33 to drop sufficiently that the level of liquid in the chamber 33 becomes below the liquid inlet 44 and air may pass from the chamber 33 up through the liquid tube 42 into the reservoir 18 to reduce the vacuum.

As seen in FIGS. 1 and 2, the liquid 26 forms a continuous column of liquid through the liquid in the chamber 33, through the liquid in the liquid tube 42 and through the liquid in the reservoir 18. Air which may enter liquid inlet 44 will flow upwardly to the top of the reservoir 18 without becoming trapped as in a trap like portion of the liquid passageway. Similarly, liquid 26 will flow downwardly from the reservoir 18 through the liquid tube 42 to the chamber 33 to effectively self prime the system, unless the vacuum in the reservoir 18 is too great.

Figure 4:
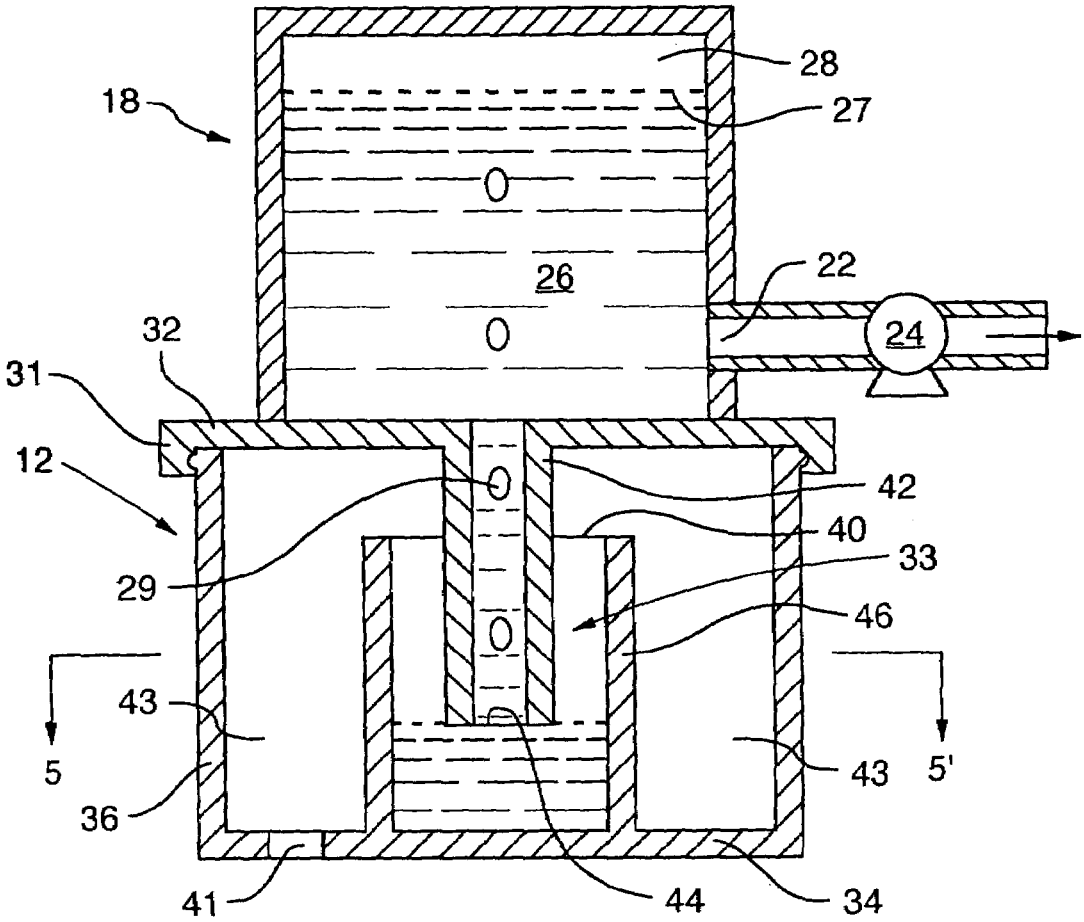
FIG. 4 is a schematic cross-sectional view of a fluid dispenser including a vacuum relief device in accordance with a second embodiment of the invention under conditions in which atmospheric air is passing into a reservoir.
Figure 5:
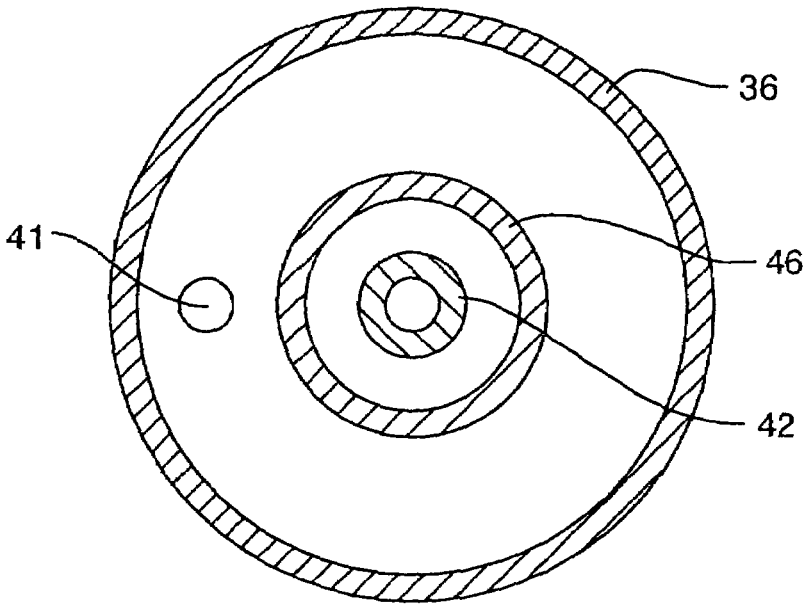
FIG. 5 is a cross-sectional view through the vacuum relief device of FIG. 4 along section lines 5-5'.

Reference is made to FIGS. 4 and 5 which show a second embodiment of a vacuum relief device 10 in accordance with the present invention illustrated in a similar schematic arrangement as the first embodiment of FIGS. 1 to 3. The second embodiment has an equivalent to every element in the first embodiment, however, is arranged such that the liquid tube 42 is coaxial with the cap 32 and a cylindrical holding tube 46 extends upwardly from the base 30 concentrically about the liquid tube 42. An air aperture 41 is provided in the base 30 opening into an annular air passageway 43 between the cylindrical side wall 36 and the holding tube 46. Conceptually, as compared to FIG. 1, the effective location and height of the air inlet 40 is at the upper open end of the holding tube 46 which is, of course, at a height above the liquid inlet 44. FIG. 4 shows a condition in which the vacuum in the reservoir 18 is sufficient that the liquid in the holding tube 46 is drawn downwardly to the level of the liquid inlet 44 and air, as in air bubbles 29, may flow upwardly through the liquid tube 42 into the reservoir 18 to relieve the vacuum.

In both the embodiments illustrated in FIGS. 1 to 3 and in FIGS. 4 and 5, the vacuum relief device is constructed of two parts, preferably of plastic by injection moulding with a cap 32 adapted to be secured in a sealing relation to be the base 30. The vacuum relief device 12 is adapted to be received within an opening into the reservoir 18 or otherwise provided to have, on one hand, communication with liquid in the reservoir and, on the other hand, communication with atmospheric air.

Figure 6:
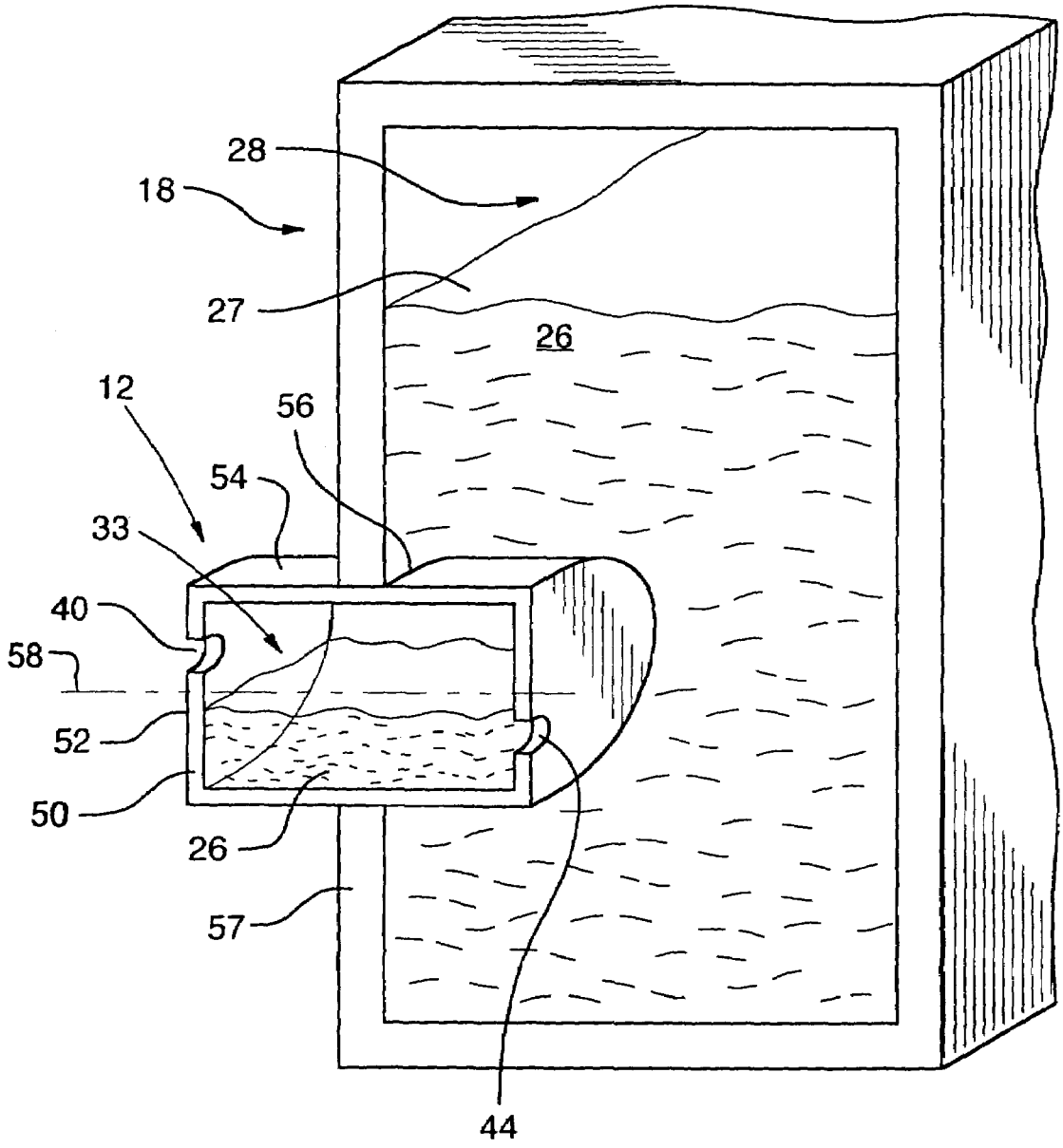
FIG. 6 is a schematic pictorial and partially sectional view of a third embodiment of a vacuum relief value in accordance with present invention.

FIG. 6 illustrates another simple embodiment of a vacuum relief device 12 in accordance with the present invention. In this embodiment, the device 12 comprises a cylindrical vessel with closed flat end walls 50 and 52 and a cylindrical side wall 54 which is adapted to be received in a cylindrical opening 56 in the side wall 57 of a reservoir 18 as shown, preferably with a central axis 58 through the cylindrical vessel disposed generally horizontally. An inner end wall 50 of the vessel has the liquid inlet 44 and the outer end wall 52 of the vessel has the air inlet 40. The vessel is to be secured to the reservoir 18 such that the air inlet 40 is disposed at a height above the liquid inlet 44. It is to be appreciated that this height relationship may be accommodated by orienting the device 10 at orientations other than with the axis 58 horizontal as shown. FIG. 6 illustrates a cross-sectional through a vertical plane including the central axis 58 and in which plane for convenience the centers of each of the air inlet 40 and liquid inlet 44 lie.

Figure 7:
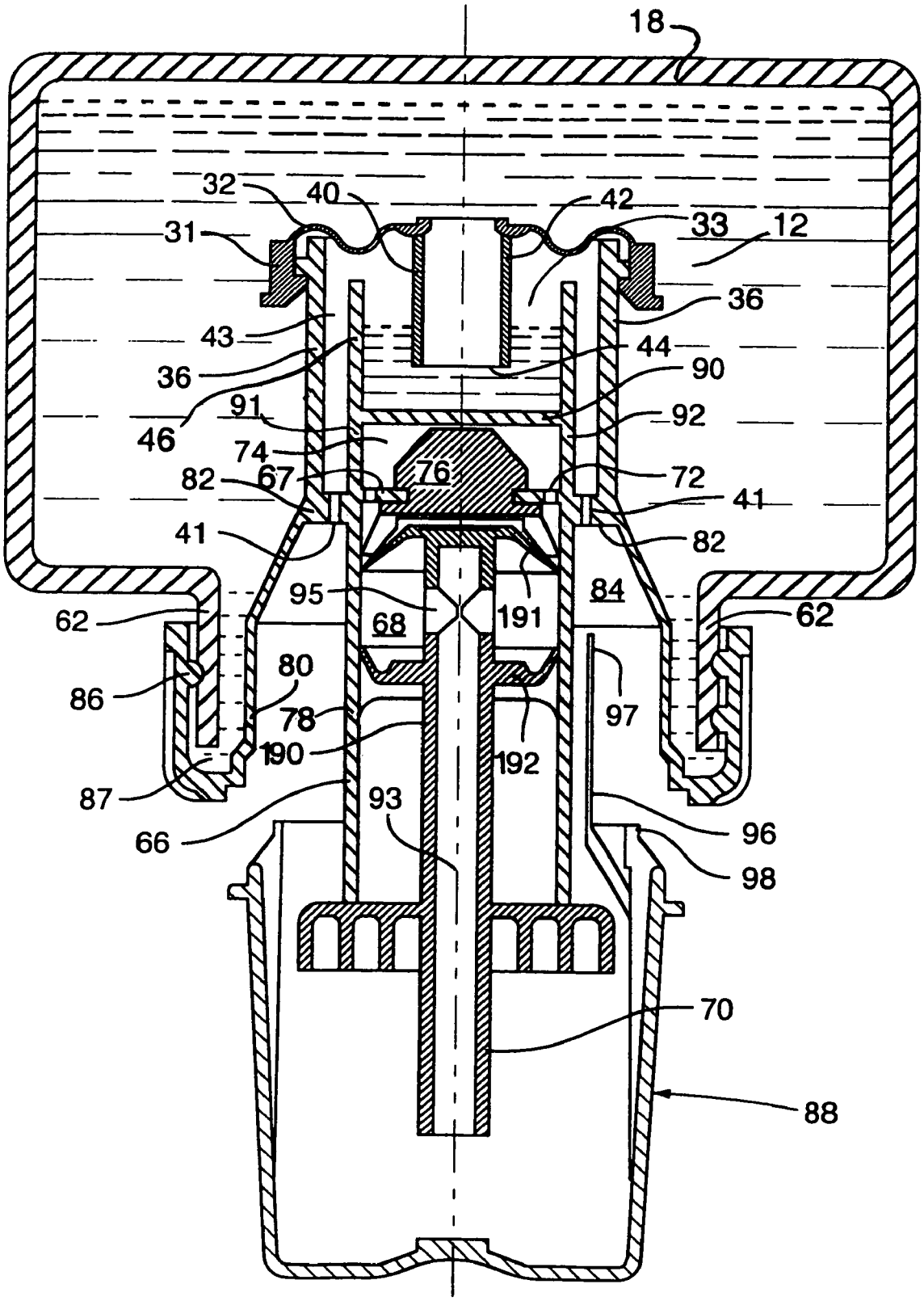
FIG. 7 is a cross-sectional side view of a liquid dispenser having a pump assembly attached to a reservoir and incorporating a vacuum relief device in accordance with a fourth embodiment of the present invention.
Figure 8:
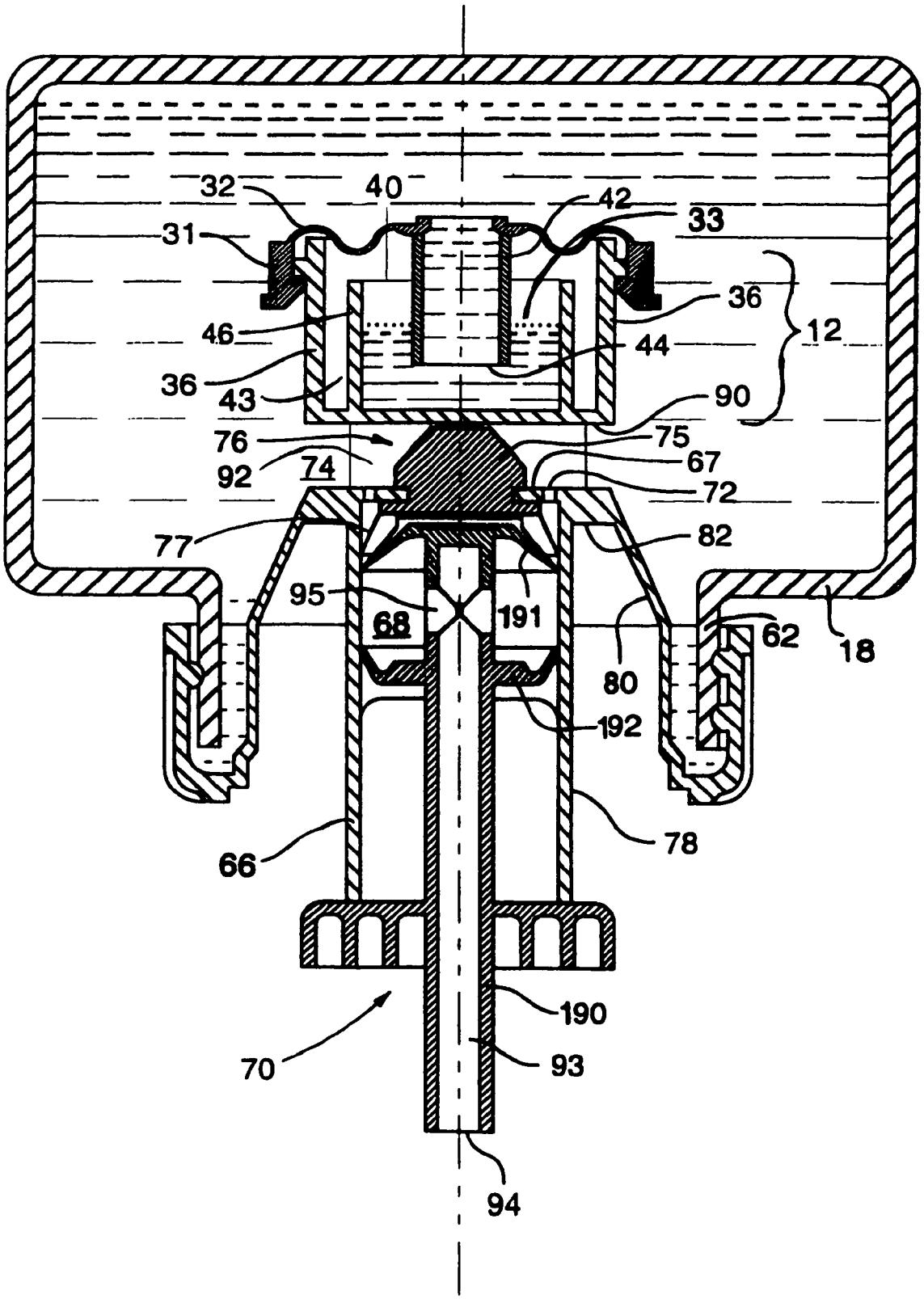
FIG. 8 is a cross-sectional side view through FIG. 7 normal to the cross-section through FIG. 7.

Reference is made to FIGS. 7 and 8 which show a liquid dispenser having a pump assembly attached to a reservoir and incorporating the vacuum relief device in accordance with the present invention. The pump assembly of FIGS. 7 and 8 has a configuration substantially as disclosed in FIG. 10 of the applicant's U.S. Pat. No. 5,676,277 to Ophardt, issued Oct. 14, 1997 (which is incorporated herein by reference) but including a vacuum relief valve device 12 in accordance with the present invention. mounted coaxially with the pump assembly inwardly of the pump assembly.

The reservoir 18 is a rigid bottle with a threaded neck 62. The pump assembly has a piston chamber-forming body 66 defining a chamber 68 therein in which a piston forming element or piston 70 is slidably disposed for reciprocal movement to dispense fluid from the reservoir. Openings 72 in the end wall 67 of the chamber 68 is in communication with the fluid in the reservoir 18 via a radially extending passageway 74 as best seen in FIG. 8. A one-way valve 76 across the opening 72 permits fluid flow outwardly from the passageway 74 into the chamber 68 but prevents fluid flow inwardly.

The piston chamber-forming body 66 has a cylindrical inner tube 78 defining the chamber 68 therein. An outer tubular member 80 is provided radially outwardly of the inner tube 78 joined by a radially extending shoulder 82 to the inner tube 78. The outer tubular member 80 extends outwardly so as to define an annular air space 84 between the outer tubular member 80 and the inner tube 78. The outer tubular member 80 carries threaded flange 86 thereon extending upwardly and outwardly therefrom to define an annular thread space 87 therebetween. The threaded flange 86 engages the threaded neck 62 of the reservoir 18 to form a fluid impermeable seal therewith.

The vacuum relief device 12 in FIGS. 7 and 8 has a configuration substantially identical to that in FIGS. 4 and 5 with coaxial upstanding side wall 36 and upstanding holding tube 46. A cap 32 sealably secured to the upper end of the side wall 36 carries the liquid tube 42 coaxially within the holding tube 46. The upper end of the liquid tube 42 is in communication with fluid in the reservoir. An annular air chamber 43 is defined between the wall 36 and the holding tube 46. Air apertures 41 provide communication between the annular air chamber 43 and the annular air space 84 which is open to atmospheric air. The apertures 41 extend through the shoulder 82 joining the inner tube 78 to the outer tubular member 80. The shoulder 82 may also be considered to join the holding tube 46 to the cylindrical wall 36. The cylindrical wall 36 may be considered an inward extension of the outer tubular member 80. The holding tube 46 may be considered an inward extension of the inner tube 78.

As best seen in FIG. 8, the passageway 74 extends radially outwardly through the holding tube 46 and the cylindrical wall 36 such that the passageway 74 is in open communication with fluid in the reservoir at diametrically opposed positions at both a first open end through one side of the wall 36 and at a second open end through the other side of the wall 36. Fluid from the reservoir is in communication via passageway 74 to the opening 72 to the piston chamber 68. The passageway 74 is defined between a top wall 90 and side walls 91 and 92 with a bottom formed by the shoulder 82 and the inner end 67 of the chamber 68. The top wall 90 forms the floor of the chamber 33 defined within the holding tube 46. FIG. 7 is a cross-sectional view normal to the passageway 74 in which the passageway 74 extends normal to the plane of the drawing sheet of FIG. 7 bounded between the top wall 90, side wall 91, side wall 92 and the inner end 67 of the chamber 68. FIG. 8 is a cross-sectional view normal to FIG. 7. In this regard, FIG. 8 is a cross-sectional view along the length of the passageway 74 which extends from the left to the right across the drawing sheet of FIG. 8 from one open end of the passageway to another open end of the passageway and with each of the open ends of the passageway open to fluid in the reservoir 18. In FIG. 8, the portion of the passageway shown is that portion which is, as seen in FIG. 8, forward of the side wall 92 and between the top wall 90 and the upper surface of the inner end 67 of the chamber 68 as well as the upper surface of the shoulder 82.

The piston chamber-forming body 66 is preferably injection moulded as a unitary element including the vacuum relief device other than its cap 32 which is preferably formed as a separate injection moulded element. The one-way valve 76 and the piston forming element 70 are also separate elements.

The one-way valve 76 has a shouldered button 75 which is secured in a snap-fit inside a central opening in the end wall 67 of the chamber 68, a flexible annular rim 77 is carried by the button and extends radially outwardly to the side wall of the inner tube 78. When the pressure in passageway 74 is greater than that in chamber 68, the rim 77 is deflected away from the walls of the inner tube 78 and fluid may flow from passageway 74 through exit openings 72 in the end wall 67 and past the rim 77 into the chamber 68. Fluid flow in the opposite direction is blocked by rim 77.

The piston-forming element or piston 70 is a preferably unitary element formed of plastic. The piston 70 has a hollow stem 190. Two circular discs 191 and 192 are located on the stem spaced from each other. An inner disc 191 resiliently engages the side wall of the chamber 68 to permit fluid flow outwardly therepast but to restrict fluid flow inwardly. An outer disc 192 engages the side walls of the chamber 68 to prevent fluid flow outwardly therepast.

The piston stem 190 has a hollow passageway 93 extending along the axis of the piston 70 from a blind inner end to an outlet 94 at an outer end. Inlets 95 to the passageway 93 are provided between the inner disc 191 and outer disc 192. By reciprocal movement of the piston 70 in the chamber 68, fluid is drawn from passageway 74 through exit openings 72 past the one-way valve 76 and via the inlets 95 through the passageway 93 to exit the outlet 94.

As fluid is pumped from the reservoir 18, a vacuum may be developed in the reservoir and the pressure relief valve 12 may permit air to enter the reservoir 18 in the same manner as described with reference to FIGS. 4 and 5.

The two air apertures 41 shown in FIG. 7 are intended to be relatively small circular openings. FIG. 7 shows a removable closure cap 88 adapted to be secured to the outer tubular member 80 in a snap-fit relation and which is removable to operate the pump. The removable closure cap 88 is shown to be provided with a pendant arm 96 which is secured to the right hand side of the closure cap and extend inwardly to present an inner plug end 97 to sealably engages within an air aperture 41 to sealably close the same. On removal of the closure cap 88, the inner plug end 97 of the pendant arm would be removed from sealing engagement in the air aperture 41. The pendant arm may be hingedly mounted to the closure cap 88 so as to be deflectable to pass outwardly about the piston forming element 70. The inner plug end 97 may be cammed and guided into the air aperture 41 on applying the closure cap 88 to the outer tubular member 80 as by engagement with the tube 78. While for ease of illustration, only one pendant arm 96 is shown, one such an arm preferably may be provided to close each air aperture 41.

Plugs to close the air apertures 41 could alternatively be a removable element independent of the closure cap 88. As well, the shoulder 82 joining the inner tube 78 to the outer tubular member 80 and the cylindrical wall 36 could be reconfigured and relocated to be at a location outwardly from where it is shown in FIG. 7 such as, for example, to be proximate the inner end 98 of the removable closure cap 88 such that the inner end 98 of the removable closure cap could serve a purpose of sealing the air apertures 41 without the need for separate pendant arms 96.

The embodiment of FIGS. 7 and 8 show a pressure relief device 12 inward of the pump assembly. The pump assembly includes the one-way valve 76 and a piston 70 with two discs 191 and 192 as disclosed in FIG. 9 of U.S. Pat. No. 5,975,360 to Ophardt issued Nov. 2, 1999.

Figure 11:
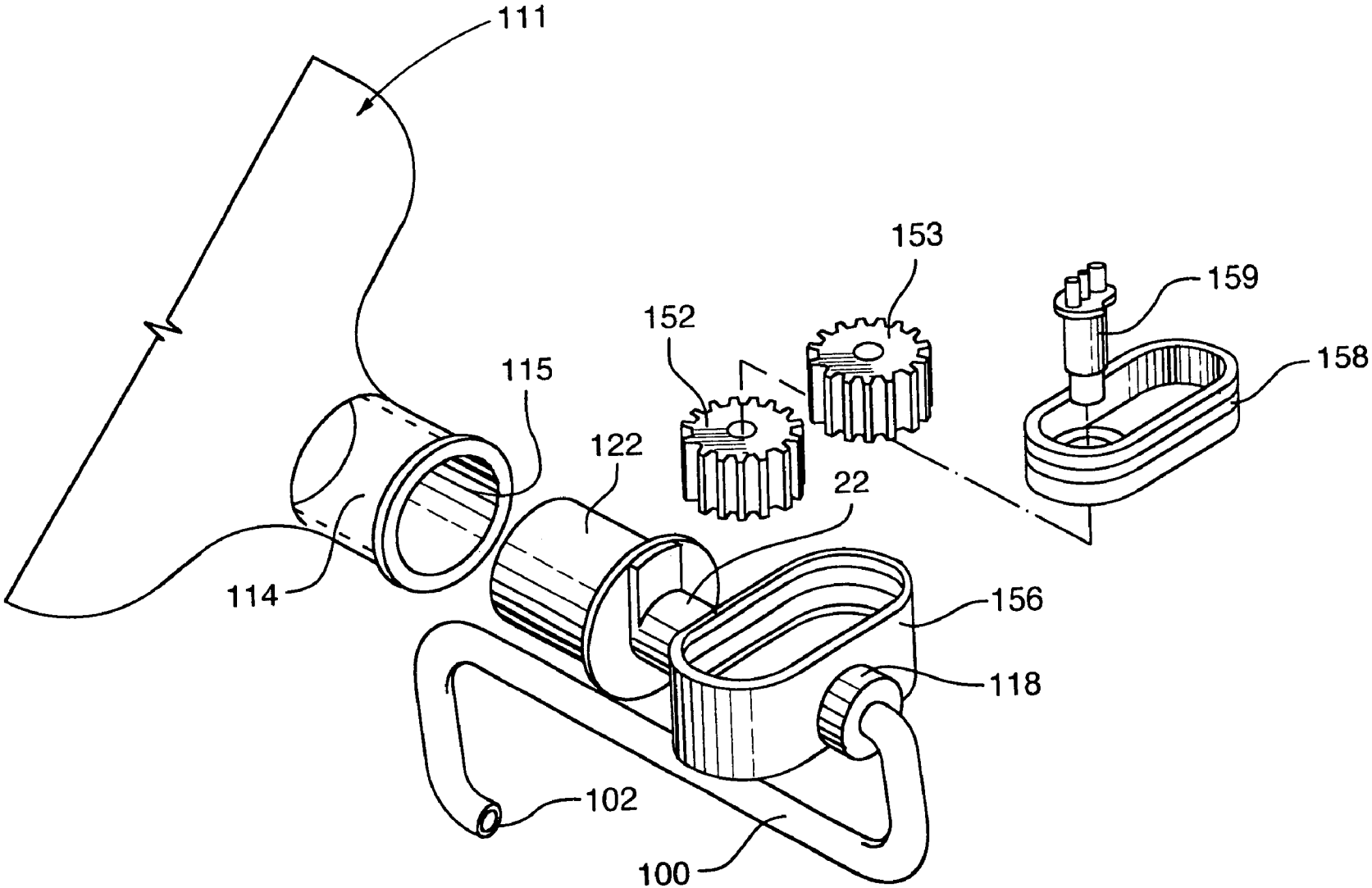
FIG. 11 is an exploded view of components of the dispenser of FIG. 10.

It is to be appreciated that the pump assembly could be substituted with a pump assembly which avoids a separate one-way valve and has three discs which could be used as disclosed, for example, in FIG. 11 of U.S. Pat. No. 5,975,360 which is incorporated herein by reference. Other pump assemblies may be used with the pressure relief device 12 similarly mounted inwardly.

FIGS. 7 and 8 illustrate an embodiment in which a removable dispensing plug is provided in the mouth of the reservoir, the dispensing plug comprising, in combination, a vacuum relief device and pump assembly with the vacuum relief device effectively coaxially disposed inwardly of the pump assembly. This is advantageous for reservoirs with relatively small diameter mouths. With larger mouths, the dispensing plug may have the pump assembly and vacuum relief device mounted side by side. In either case, as seen, the piston chamber-forming element 66 may comprise a unitary element formed by injection moulding and including (a) an element to couple to the mouth of the reservoir, namely, outer tubular member 80, (b) the inner tube 78 to receive the piston 70, (c) the side wall 36, and (d) the holding tube 46.

Figure 9:
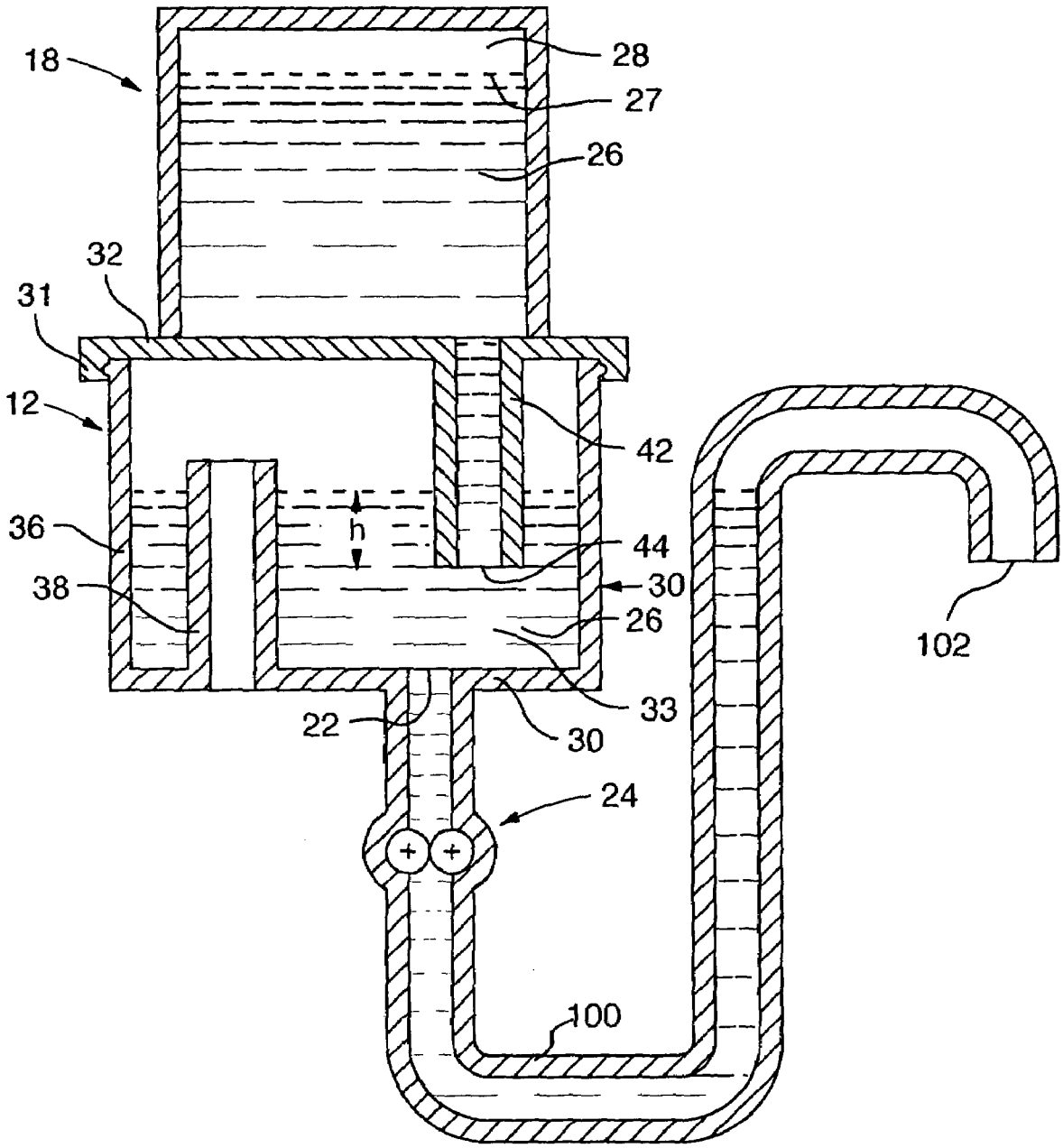
FIG. 9 is a schematic cross-sectional view of a fluid dispenser including a vacuum relief device in accordance with a fifth embodiment of the present invention.

Reference is made to FIG. 9 which schematically shows an embodiment in accordance with the present invention very similar to that shown in FIGS. 1 to 3, however, with the pump 24 disposed so as to draw fluid from the chamber 33 rather than from the reservoir 18. In this regard, the outlet 22 for the pump 24 is shown as being provided to extend from the base 30 at a height below the liquid inlet 44. Fluid from the pump 24 flows via an outlet tube 100 to an outlet 102.

FIG. 9 shows the reservoir 18, the vacuum relief device 12 and the outlet 102 at preferred relative heights in accordance with the present invention. FIG. 9 shows a condition in which the pump is not operating and the level of the liquid 26 assumes in the outlet tube 100 as being at a height which is effectively the same as the height of the level of the liquid 26 in the chamber 33. The height of the level of the liquid 26 in the chamber 33 and, therefore, in the outlet tube 100, is selected to be below the height of the outlet 102. With this arrangement, liquid does not have a tendency to drip out the outlet 102 even though liquid in the reservoir 18 is at a height above the outlet 102. This configuration is particularly advantageous for use with relatively low viscosity liquids such as alcohol solutions as are used in disinfecting and hand cleaning in hospitals. Dispensers for such alcohol solutions frequently suffer the disadvantage that the alcohol will drip out of the outlet and, while it has previously been known in the past to provide the outlet for the alcohol at a height above the level of alcohol in the reservoir, this is, to some extent, impractical and increases the pressure with which the alcohol needs to be pumped by the pump to be moved to a height above the height of the alcohol in the reservoir. In accordance with the embodiment illustrated in FIG. 9, the pressure relief device 12 can be of relatively small dimension and, therefore, the outlet 102 needs only be raised a relatively small amount to place the outlet 102 at a height above the level of the liquid 26 in the chamber 33. For example, the height of a typical reservoir is generally in the range of six to eighteen inches whereas the height of the vacuum relief device 12 may be only in the range of about one inch or less.

FIG. 9 schematically illustrates the pump 24. This pump may preferably comprise a pump as disclosed in the applicant's U.S. Pat. No. 5,836,482, issued Nov. 17, 1998 to Ophardt and U.S. Pat. No. 6,343,724, issued Feb. 5, 2002 to Ophardt, the disclosures of which are incorporated herein by reference. Fluid dispensers with such pumps preferably have configurations to reduce the frictional forces arising in fluid flow which need to be overcome by the pump so as to increase the useful life of batteries and, therefore, minimize the size and quantities of batteries used. The embodiment illustrated in FIG. 9 has the advantage that a one-way valve is not required to prevent dripping from the outlet and, thus, during pumping, there is a minimum of resistance to fluid flow since fluid may flow directly from the reservoir to the chamber 33, from the chamber 33 to the pump 24 and, hence, from the pump 24 via the outlet tube 100 to the outlet 102. The relative height of the outlet 102 above the height of the liquid inlet 44 ensures there will be no dripping. Thus, the vacuum relief device 12 as used in the context of FIG. 9 not only serves a purpose of providing a convenient structure to permit air to pass upwardly into the reservoir 18 to relieve any vacuum developed therein, but also provides an arrangement by which a mechanical valve is not required to prevent dripping and in which the height at which the outlet must be located is below the height of the liquid in the reservoir 18 and merely needs to be above the height of the liquid in the chamber 33.

While the schematic embodiment illustrated in FIG. 9 shows the pump as disposed below the vacuum relief device 12, it is to be appreciated that the pump could readily be disposed to one side, further reducing the length of the outlet tube.

Figure 10:
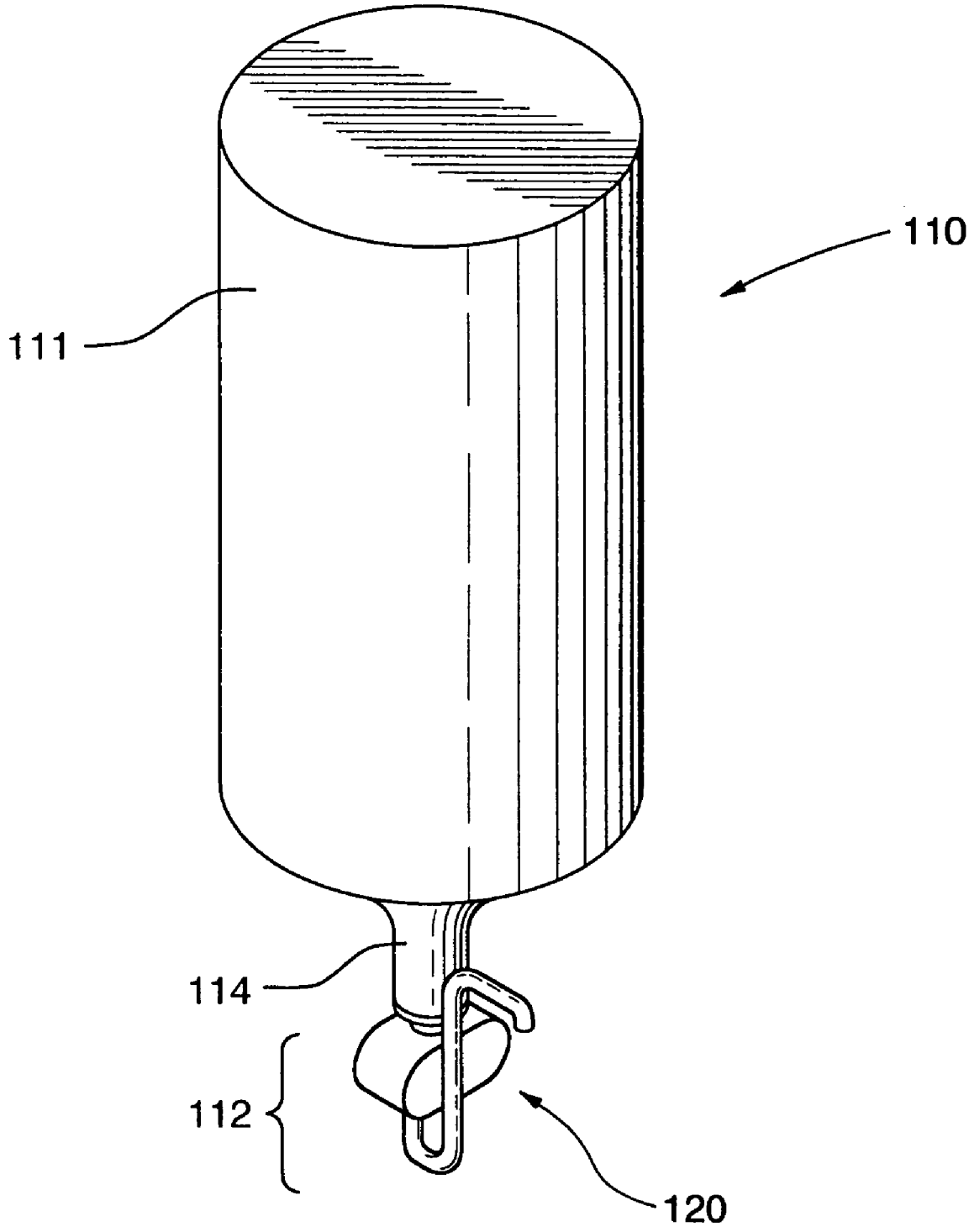
FIG. 10 is a pictorial view of a fluid dispenser in accordance with a sixth embodiment of the present invention.
Figure 12:
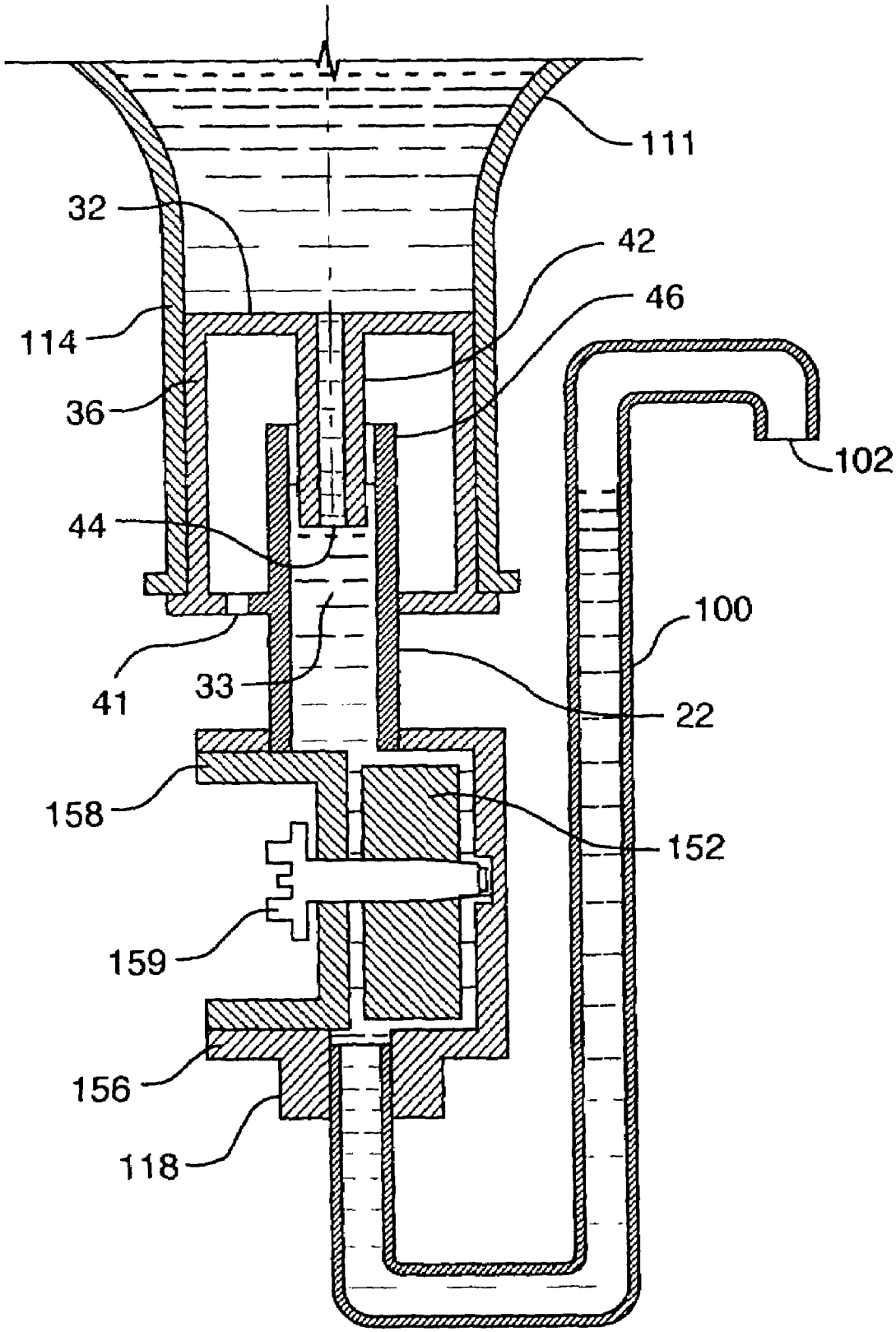
FIG. 12 is a vertical cross-sectional view through the dispenser of FIG. 10.

FIGS. 10, 11 and 12 show an arrangement as taught in FIG. 9 utilizing as the pump a pump in U.S. Pat. No. 6,343,724, the disclosure of which is incorporated herein by reference. The dispenser generally indicated 110 includes a non-collapsible fluid container 111 with outlet member 114 providing an exit passageway 115 for exit of fluid from the container 111.

The pump/valve assembly 112 is best shown as comprising several separate elements, namely, a feed tube 122, a pump 120 and an outlet tube 100. The pump 120 includes a pump casing 156, a drive impeller 152, a driven impeller 153, a casing plug 158 and a drive shaft 159.

The cylindrical feed tube 122 is adapted to be received in sealing engagement in the cylindrical exit passageway 115 of the outlet member 114. The feed tube 122 incorporates a vacuum relief device in accordance with the present invention and the cylindrical feed tube 122 is best seen in cross-section in FIG. 12 to have a configuration similar to that in FIG. 4, however, with the notable exception that the outlet 22 is provided as a cylindrical outer extension of the holding tube 46. The cap 32 is provided to be located in a snap-fit internally within the cylindrical side walls 36. The outlet 22 leads to the pump 120 from which fluid is pumped by rotation of the impellers 152 and 153. The outlet tube 100 is a separate element frictionally engaged on a spout-like outlet 118 on the pump casing 156. The outlet tube 100 has a generally S-shaped configuration and extends upwardly so as to provide its outlet 102 at a height above the height of the liquid inlet 44. As seen in FIG. 12, the fluid in the outlet tube 100 assumes the height of the fluid in the chamber 33 which is below the height of the outlet 102 so that there is no dripping out of the outlet 102.

The embodiment of FIG. 12 is particularly advantageous for liquids of low viscosity such as alcohol and water based solutions in which dripping can be an increased problem. The embodiment of FIG. 12 does not require a mechanical one-way valve to prevent dripping and can have fluid dispensed though it with minimal effort. The dispenser illustrated is easily primed and will be self-priming since the gear pump is a pump which typically, when it is not operating, permits low viscosity fluids to slowly pass therethrough. As disclosed in U.S. Pat. No. 6,343,724, the drive shaft 159 is adapted to be coupled to a motor, preferably a battery operated motor, maintained in a dispenser housing. The entirety of the pump assembly shown in FIG. 12 can be made of plastic and be disposable.

Figure 13:
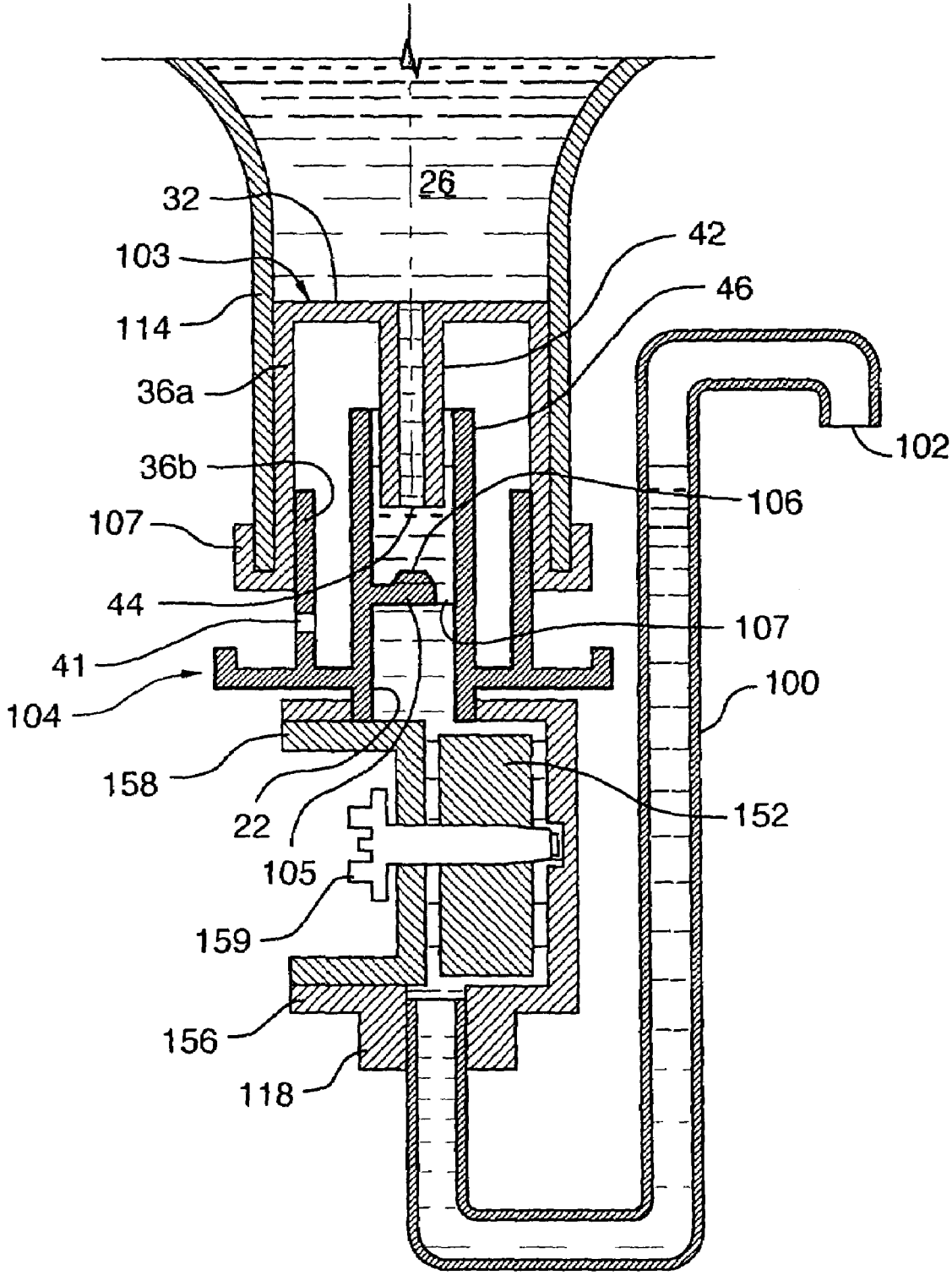
FIG. 13 is a vertical cross-section through a dispenser in accordance with a seventh embodiment of the present invention similar to the embodiment shown in FIG. 12 and in an open position.
Figure 14:
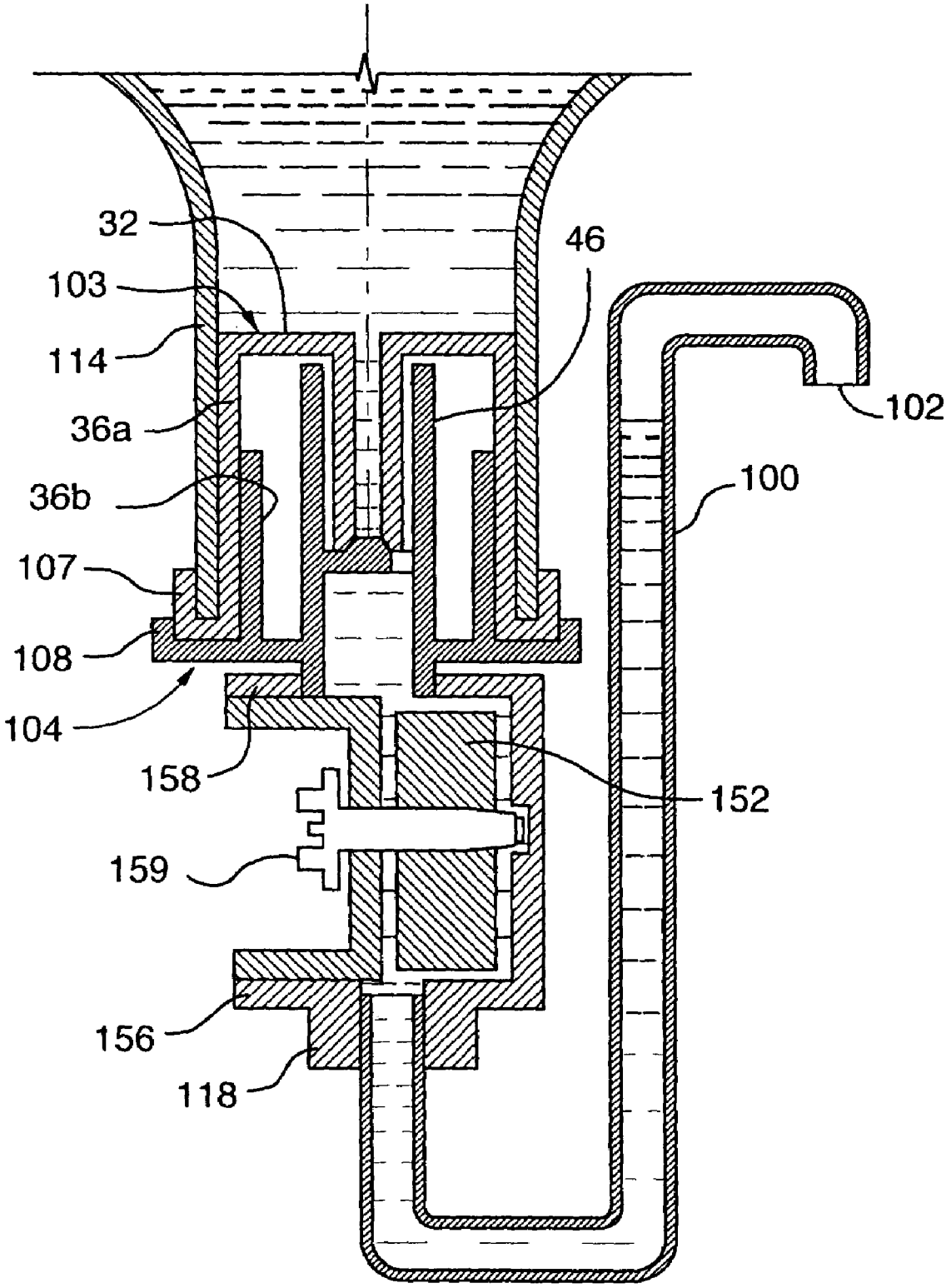
FIG. 14 is a vertical cross-sectional of the dispenser of FIG. 13 in a closed position.

Reference is made to FIGS. 13 and 14 which show a modified form of the dispenser of FIG. 12. The embodiment of FIGS. 13 and 14 is identical to that of FIG. 12 with the exception that the pressure relief device is made from two different parts, namely, an inner element 103 and an outer element 104. The inner element 103 is a unitary element comprising the cap 32 merged with an outer cylindrical wall **36*a*** ending at an outwardly extending cylindrical opening.

The outer element 104 includes the holding tube 46, the exit tube 22 and the base 30 merged with an inner cylindrical wall 36*b* ending at an inwardly extending cylindrical opening. An air aperture 41 is provided in an outermost portion of the inner cylindrical wall 36*b*. The outer element 104 is coaxially received in the inner element 103 for relative axial sliding between the open position of FIG. 13 to the closed position of FIG. 14. The inner and outer cylindrical walls 36*b* and 36*a* engage each other to form a fluid impermeable seal therebetween.

The outer element 104 includes within the holding tube 46 a disc-like closure member 105 carrying an inwardly extending central plug 106 to engage the liquid inlet 44 and close the same. Radially outwardly of the central plug 106, the closure member 105 has an opening 107 therethrough for free passage of the fluid 26.

In open position as shown in FIG. 13, the pressure relief valve 12 functions identically to the manner in FIG. 12. In the closed position of FIG. 14, the plug 106 engages the liquid inlet 44 and prevents flow of fluid from the reservoir 18 via liquid tube 42. As well, in the closed position of FIG. 14, the air aperture 41 is closed by being covered by the outer cylindrical wall 36*a*. Various mechanisms may be provided to releasably lock the outer element 104 in the locked and unlocked positions. In the axial sliding of the inner element 103 and outer element 104, the plug 106 acts like a valve movable to open and close a liquid passageway through the liquid tube 42. Similarly, the outer cylindrical wall 36*a* acts like a valve movable to open and close an air passageway through the air aperture 41.

FIGS. 13 and 14 show the inner element 103 carrying on its outer cylindrical wall 36*a* a lip structure 107 to engage the mouth of the container's outlet member 114 in a snap friction fit relation against easy removal.

The outer element 104 is also shown to carry on its inner cylindrical wall 36*b* a lesser lip structure 108 to engage the inner element 103 and hold the outer element 104 in a closed position until the lip structure 108 may be released to move the outer element 104 to the open position. Various other catch assemblies, thread systems and frangible closure mechanisms may be utilized.

The container 111 filled with liquid with its outlet member 114 directed upwardly may have a pump assembly as shown in FIG. 14 applied thereto in a closed position to seal the fluid in the container. For use, the container may be inverted and the outer element 104 moved axially outwardly to the open position of FIG. 13. Preferably, a dispenser housing to receive the container 111 with the pump assembly attached may require, as a matter of coupling of the container and pump assembly to the housing, that the outer element 104 necessarily be moved to the open position of FIG. 13.

Each of the inner element 103 and outer element 104 may be an integral element formed from plastic by injection moulding.

Reference is made to FIGS. 15 to 19 which shows another embodiment of a fluid dispenser in accordance with the present invention.

Figure 15:
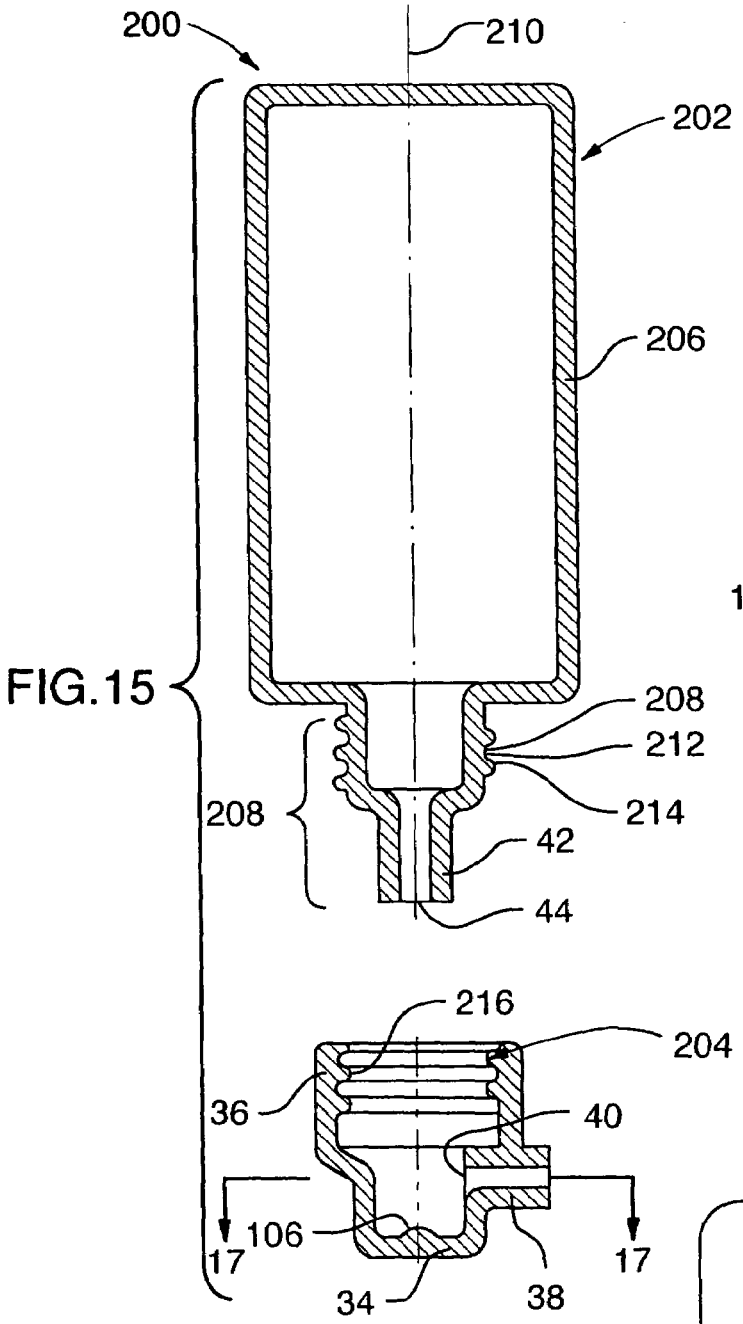
FIG. 15 is an exploded side view of a liquid dispenser in accordance with an eighth embodiment of the present invention.
Figure 17:
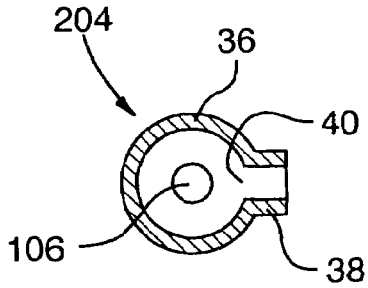
FIG. 17 is a cross-sectional end view of the cap shown in FIG. 15 along section line A-A'.

FIG. 15 shows the dispenser 200 including a bottle 202 and a cap 204.

Figure 16:
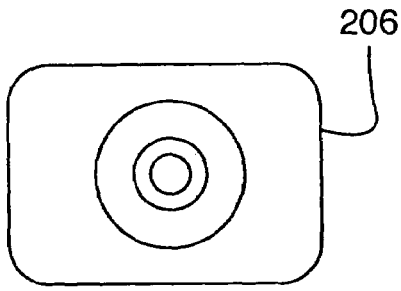
FIG. 16 is an end view of the bottle shown in FIG. 15.

The bottle 202 has a body 206 which is rectangular in cross-section as seen in FIG. 16 and a neck 208 which is generally circular in cross-section about a longitudinal axis 210. The neck 208 includes a threaded inner neck portion 212 carrying external threads 214. The inner portion 212 merges into a liquid tube 42 of reduced diameter.

The cap 204 has a base 34 with a cylindrical side wall 36 carrying internal threads 216 adapted to engage the threaded neck portion 212 in a fluid sealed engagement. An air tube 38 extends radially from the side wall 36. A central plug 106 is carried on the base 34 upstanding therefrom. In an assembled closed position as seen in FIG. 18, the cap 204 is threaded onto the neck 208 of the bottle 202 to an extent that the plug 106 engages the end of the liquid tube 42 and seals the liquid tube 42 so as to prevent flow of fluid into or out of the bottle 202.

From the position of FIG. 18, by rotation of the cap 204 180° relative the bottle 202, the cap 204 assumes an open position in which the neck of the bottle and the cap form a vacuum relief device with the liquid tube 42 having a liquid inlet 44 at a height below the height of an air inlet 40 at the inner end of the air tube 38. With the bottle in the inverted position with its neck down as shown, cap and neck will function not only as a vacuum relief valve but also as a dispensing outlet. In this regard, the bottle 202 is preferably a resilient plastic bottle as formed by blow moulded which has an inherent bias to assume an inherent shape having an inherent internal volume. The bottle may be compressed as by having its side surfaces moved inwardly so as to be deformed to shapes different than the inherent shape and having volumes less than the inherent volume but which, on removal of compressive fences, will assume its original inherent shape.

Figure 18:
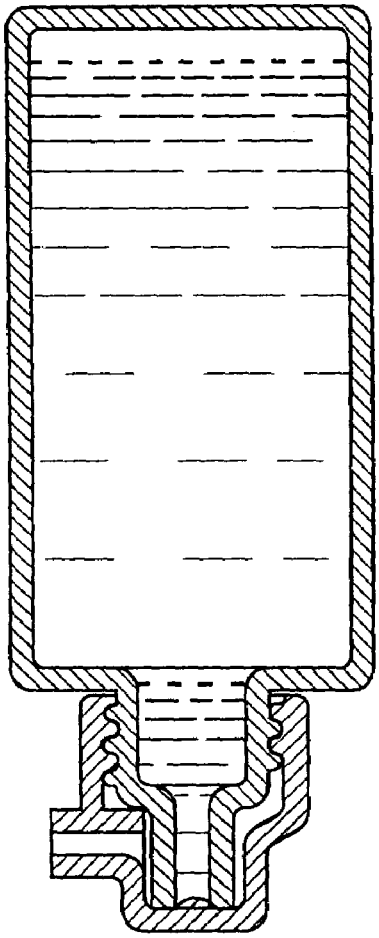
FIG. 18 is a side view of the liquid dispenser of FIG. 15 in a closed position.

With the bottle in the position of FIG. 18 on compressing the bottle, as by manually squeezing the bottle, fluid 26 in the bottle is pressurized and forced to flow out of the liquid tube 42 into the chamber 33 in the cap 202 and, hence, out the air tube 38. On ceasing to compress the bottle, the bottle due to its resiliency, will attempt to resume its normal shape and, in so doing, will create a vacuum in the bottle, in which case the liquid tube 42 and air tube 38 in the cavity 33 will act like a vacuum relief valve in the same manner as described with the embodiment of FIGS. 1 to 6.

The bottle and cap may be mounted to a wall by a simple mounting mechanism and fluid dispensed merely by a user pushing on the side of the bottle into the wall. The bottle and cap could be mounted within an enclosing housing with some mechanism to apply compressive forces to the side of the bottle, as in response to movement of a manual lever or an electrically operated pusher element.

Figure 19:
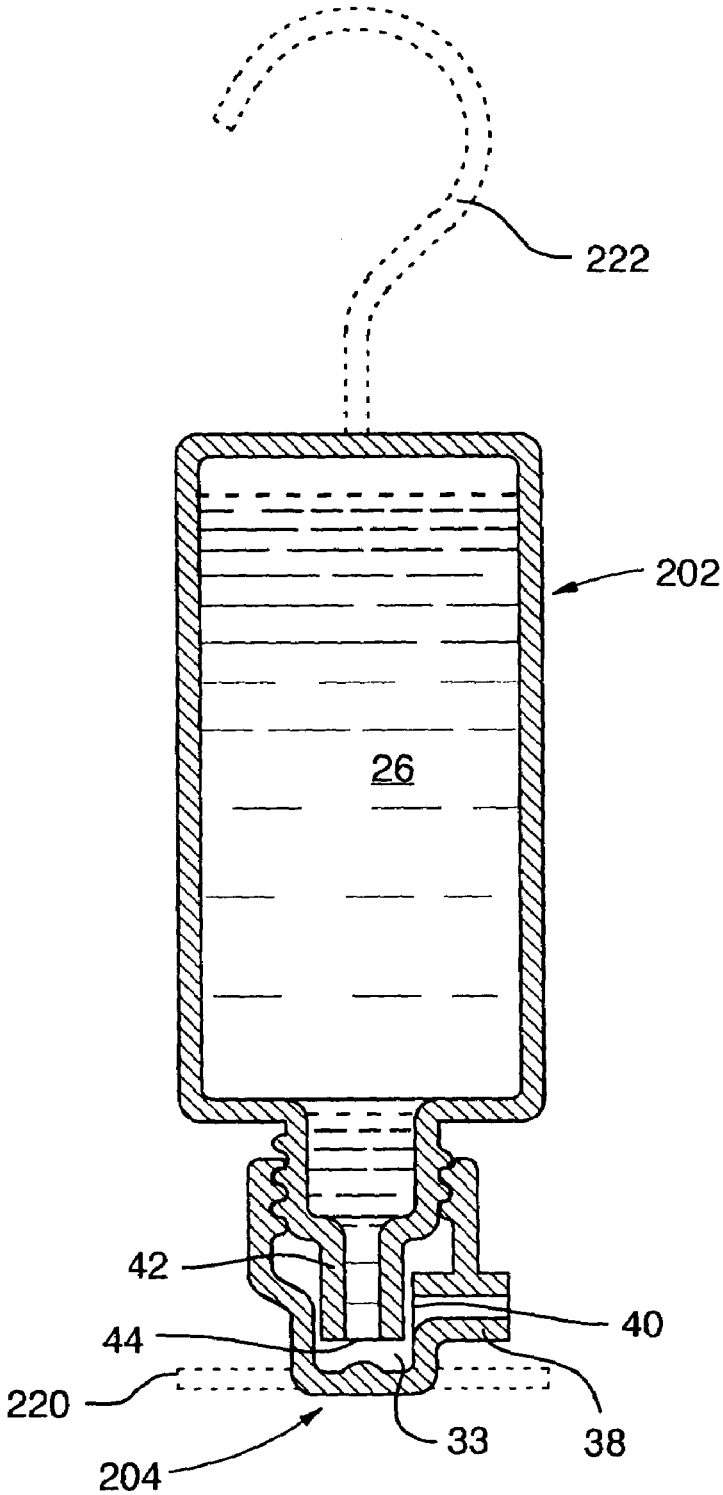
FIG. 19 is a side view of the liquid dispenser of FIG. 15 in an open position.

The bottle and cap may be adapted to be stored ready for use in the open position inverted as shown in FIG. 19 and an extension of the base 34 of the cap 204 is shown in dotted lines as 220 to provide an enlarged platform to support the bottle and cap inverted on a flat surface such as a table. In use, the bottle and cap may be kept in an inverted open position and liquid will not drip out since the liquid in the chamber 33 will assume a level below the liquid inlet 42 and the air inlet 40. Alternatively, a hook may be provided, as shown in dashed lines as 222 in FIG. 9, to hang the bottle and cap inverted in a shower. The bottle and cap need be closed merely for shipping and storage before use.

Figure 20:
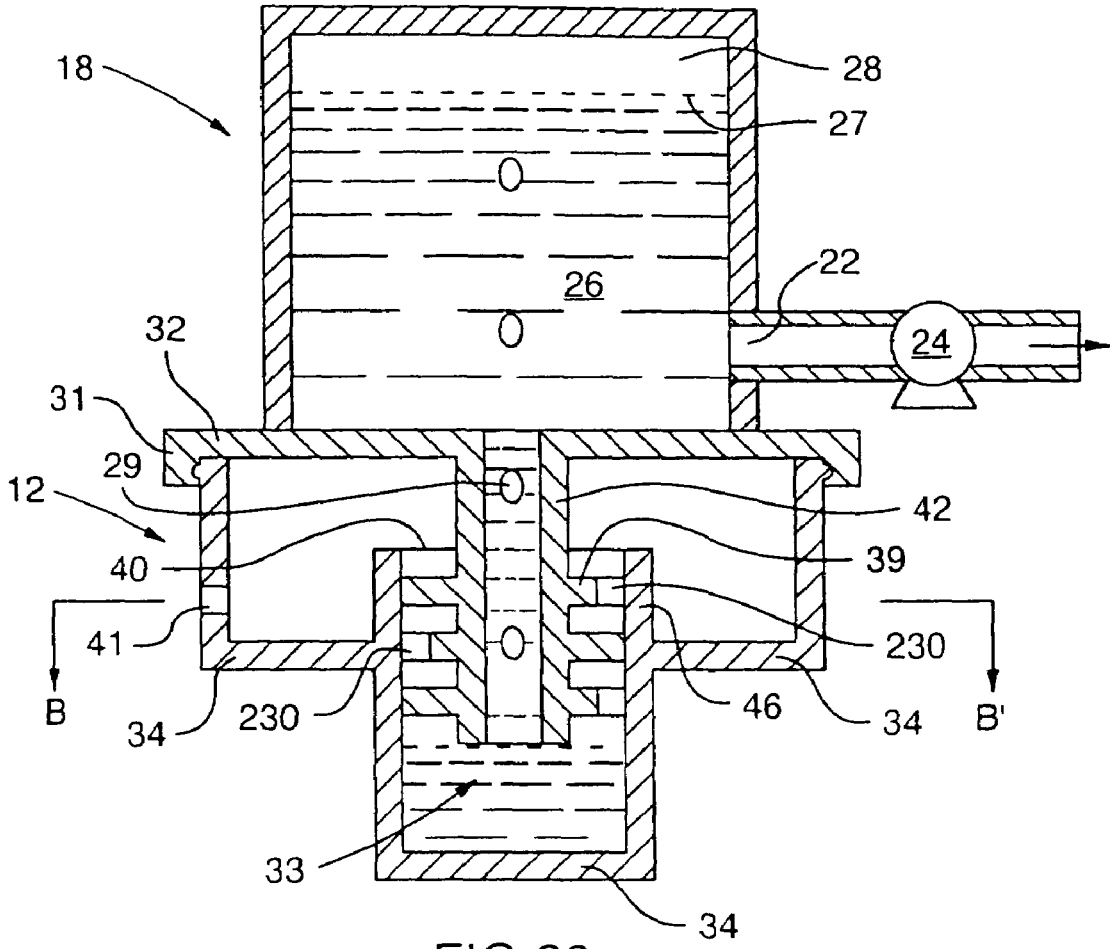
FIG. 20 is a schematic cross-sectional view for a fluid dispenser substantially the same as that shown in FIG. 4.
Figure 21:
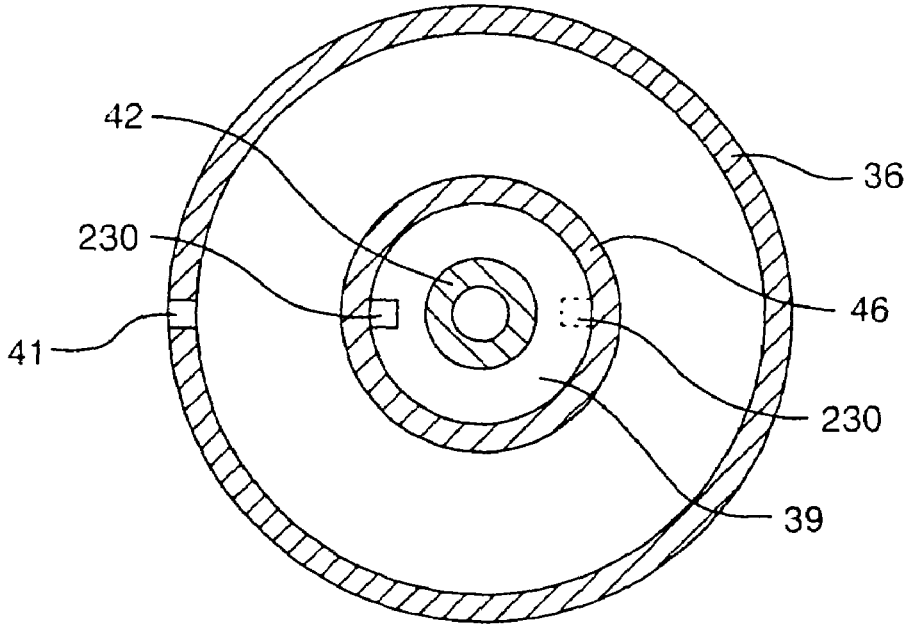
FIG. 21 is a cross-sectional view through FIG. 4 along section line B-B'.

Reference is made to FIGS. 19 and 20 which shows a device identical to that in FIGS. 4 and 5 but for firstly, the location of the air aperture 41 in the side wall 36, secondly, providing the base 34 to be at different heights under the holding tube 46 than under the annular air passageway 43 and, thirdly, the liquid tube 42 carries on its outer surface a plurality of spaced radially outwardly extending annular rings 39 which extend to the tube 46. Each ring has an opening 230 adjacent its outer edge to permit flow between the tube 42 and the tube 46.

The openings 230 on alternate rings are disposed 180° from each other to provide an extended length flow path for fluid flow through the passageway between liquid tube 42 and holding tube 46.

These annular rings are not necessary. They are intended to show one form of a flow restriction device which may optionally be provided to restrict flow of liquid but not restrict flow of air therethrough. The purpose of the annular rings is to provide reduced surface area for flow between the liquid tube 42 and the holding tube 46 as through relatively small spaces or openings with the spaces or openings selected to not restrict the flow of air but to provide increased resistance to flow of liquids, particularly viscous soaps and the like, therethrough. This is perceived to be an advantage in dispensers where liquid flow out of air inlet 40 is not desired, should a condition arise in which liquid is attempting to pass from inside the tube 42 through the inside of tube 40 and out of the air inlet 40 or air opening 41. Having increased resistance to fluid flow may be of assistance in reducing flow leakage out of the air apertures 41 under certain conditions.

Figure 22:
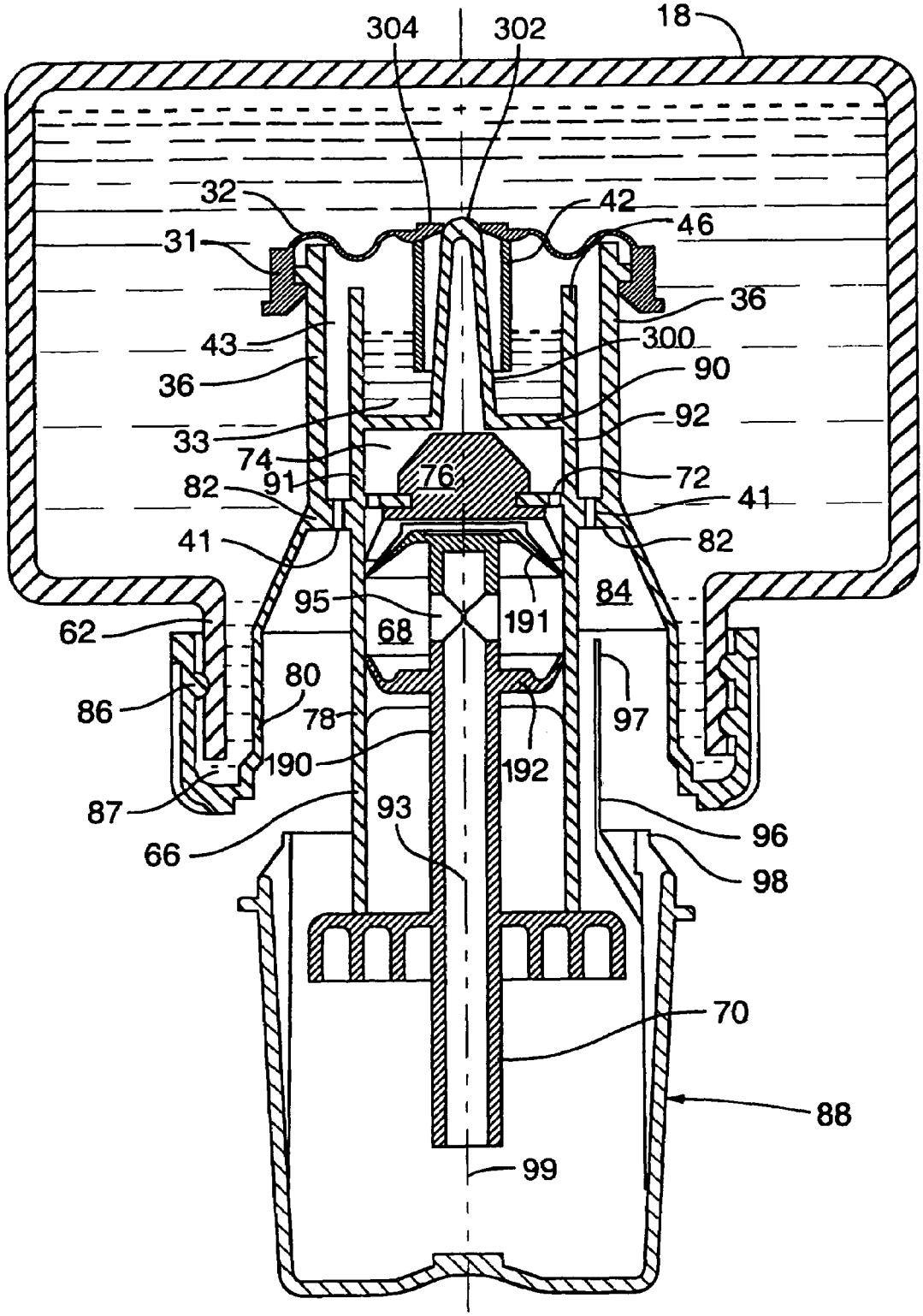
FIG. 22 is a schematic cross-sectional view similar to FIG. 7 but of a further embodiment of the present invention with a one-way valve in a closed position.
Figure 23:
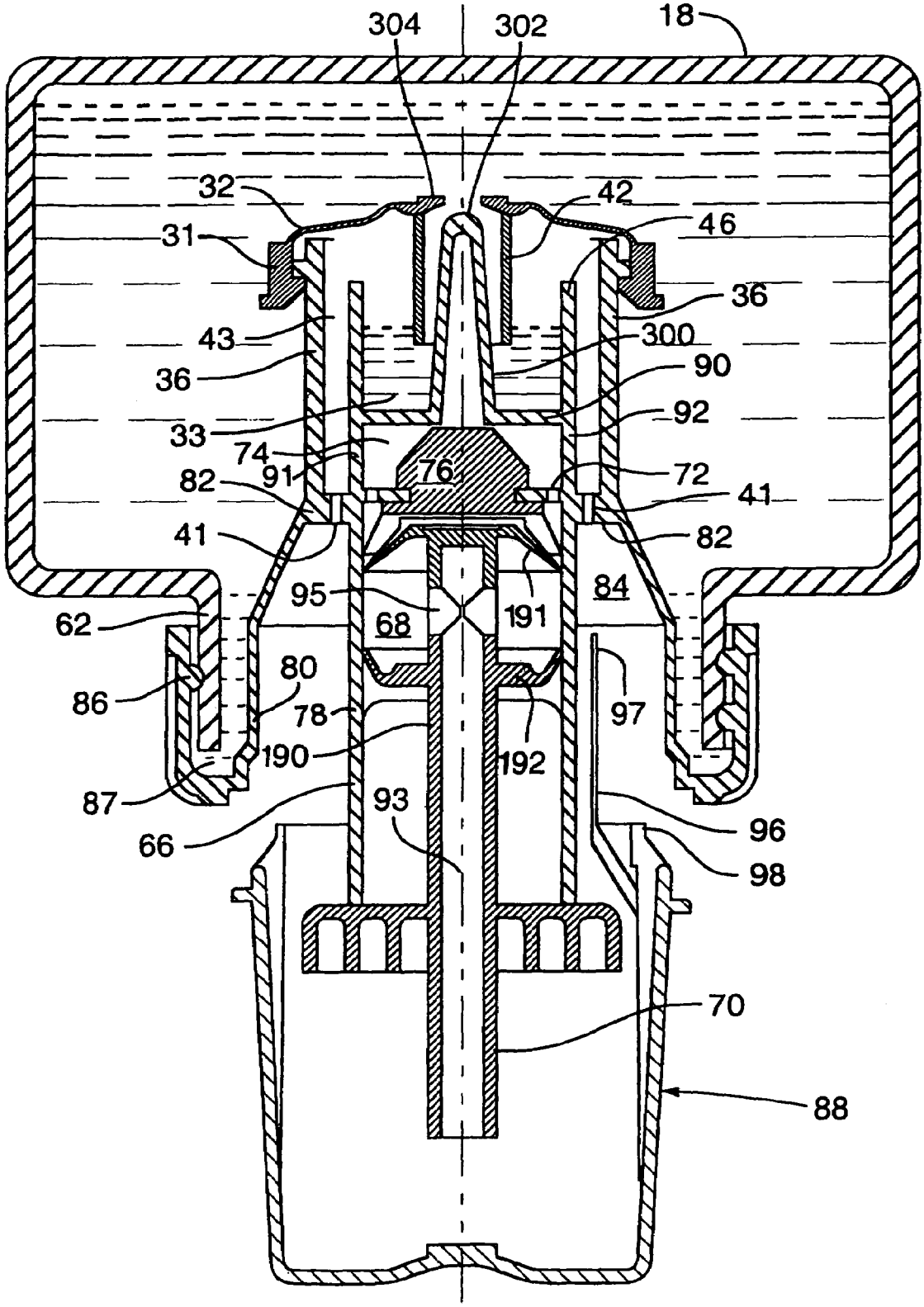
FIG. 23 is the same as FIG. 22 but with the one-way valve in an open position.

Reference is made to FIGS. 22 and 23 which illustrate an embodiment which is identical to that illustrated in FIG. 7 but for two changes.

Firstly, a male valve seat 300 is provided to extend upwardly coaxially about the axis 99 from the top wall 90 where the top wall forms the floor of the chamber 33, and secondly, the cap 32 extends radially inwardly beyond the liquid tube 42 to provide a reduced diameter annular female valve seat 304 adapted to engage the upper end 302 of the male valve seat 300. The cap 32 is flexible preferably formed to have an inherent bias to assume a closed, seated position as illustrated in FIG. 22 so as to prevent fluid flow into the liquid tube 42 by the female valve seat 304 being biased downwardly into engagement with the annular periphery of the male valve seat 300 proximate it's upper end 302.

Under conditions when a vacuum may come to be developed within the reservoir 18 as compared to the pressure in chamber 33, the cap 32 will deflect upwardly such that the female valve seat 304 lifts off the male valve seat 300 in an open position as illustrated in FIG. 23 permitting fluid flow through the liquid tube 42 to equalize the pressure between the chamber 33 and the reservoir 18. The embodiment illustrated in FIGS. 22 and 23 is adapted, in a preferred normal use, to rely on the inherent resiliency of the cap 32 and its selective seating and unseating on the male valve seat 300 to as a first mechanism to control when air may be permitted to pass into the reservoir 18 to equalize pressure. When the cap 32 is not seated on the male valve seat 300 as in FIG. 23 then a second mechanism namely the pressure relief device the same as in FIG. 7 controls how air may be permitted to pass into the reservoir 18 to equalize pressure.

The cap 32 is preferably formed of a resilient plastic material which is biased to assume a closed position as illustrated in FIG. 22. Typically such a cap 32 will have a tendency to lose it inherent bias and with time to commence to adopt as its permanent configuration the unseated configuration illustrated in FIG. 23. The time that it takes for any resilient cap 32 to lose its resiliency may depend upon the nature of the plastic material and the nature of the liquid in the reservoir 18 with which the cap 32 is in contact.

Insofar as the cap 32 loses it resiliency and therefore tends to permanently assume the open configuration illustrated in FIG. 23, then the vacuum relief device will operate in the same manner as that illustrated in FIG. 7 that is, as though the liquid tube 42 was at all time open at its upper end.

Figure 24:
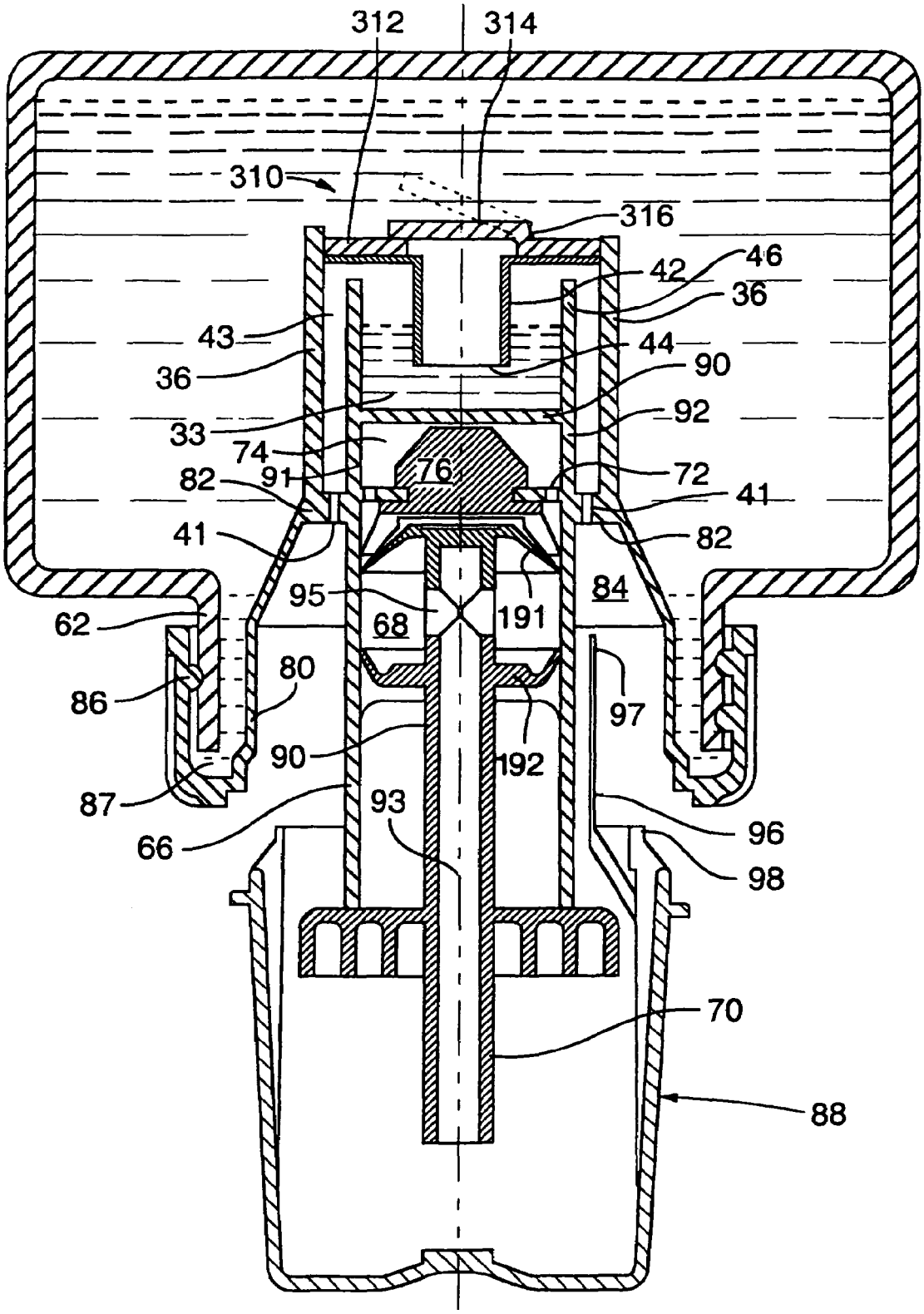
FIGS. 24 and 25 are schematic cross-sectional views similar to FIG. 22 but with two different one-way valves.

Reference is made to FIG. 24 which illustrates an embodiment substantially the same as in FIG. 22 but using a simple one-way valve generally indicated 310 and having valve seat 312 annularly about the upper opening to liquid tube 42 upon which valve member 314 is adapted to seat to close the valve 310. The valve member 314 is movable between the closed position shown in solid lines and an open position shown in dashed lines. The valve member 314 may under gravity alone assume the closed position. Alternatively the valve member 314 may be biased to the closed position as by inherent bias of a bridge 316 joining the valve member 314 to the valve seat 312.

Figure 25:
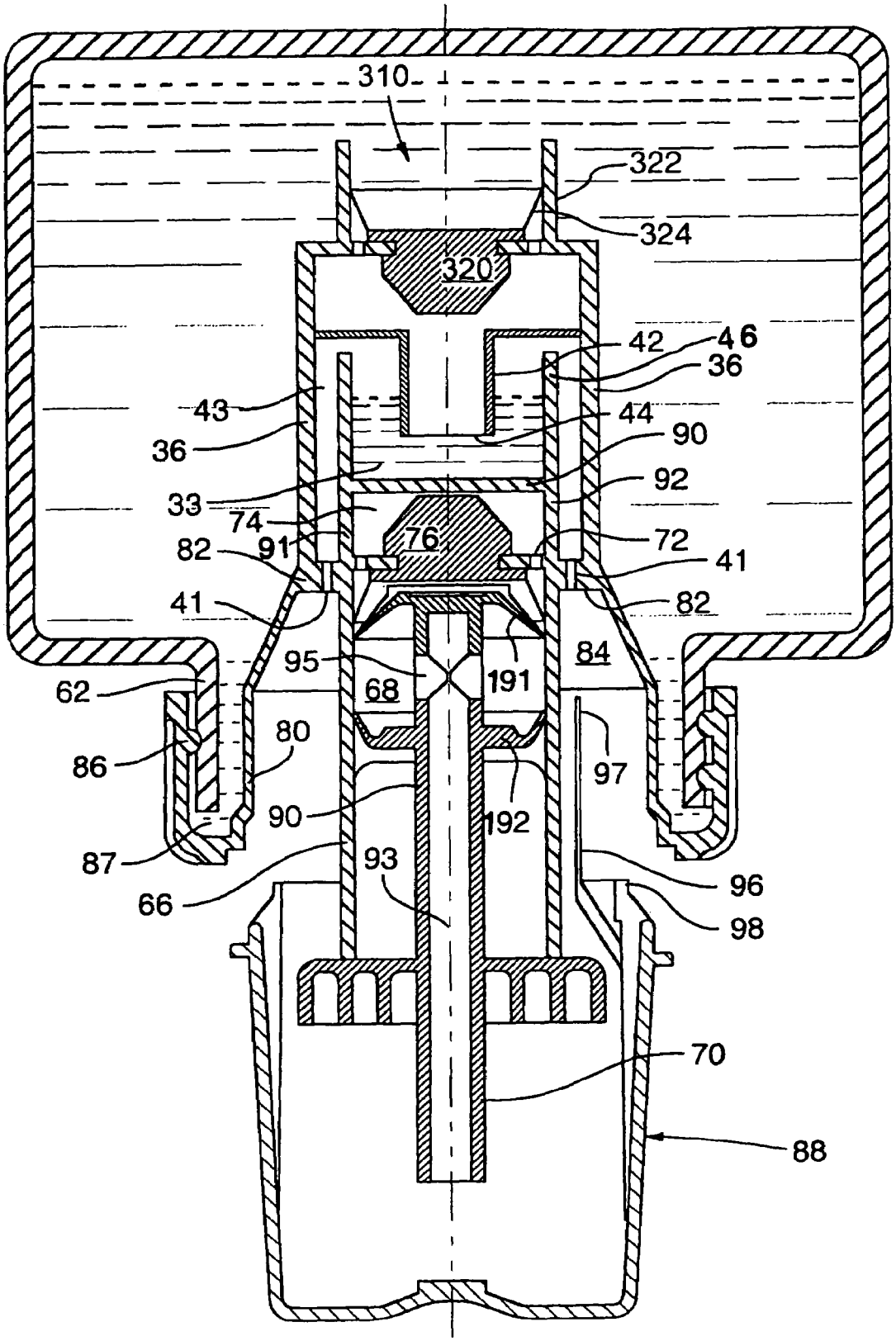

Reference is made to FIG. 25 which illustrates an embodiment the same as in FIG. 24 but using a one-way valve generally indicated 320 which is the same as one-way valve 76 but is secured in a tube 322 forming an entranceway to the liquid tube 42. Valve 320 has a flexible annular flange 324 biased radially outwardly into the inside of the tube 322.

While the invention has been described with reference to preferred embodiments, many modifications and variations will now occur to persons skilled in the art. For a definition of the invention, reference is made to the appended claims.

I claim:

1. In combination, an enclosed, liquid containing reservoir and a vacuum relief mechanism comprising a vacuum relief device and a one-way valve;

the reservoir having a reservoir outlet from which liquid is to be dispensed and within which reservoir a vacuum below atmospheric pressure is developed on dispensing liquid from the reservoir outlet, the vacuum relief device is adapted to permit atmospheric air to enter the reservoir to reduce any vacuum developed in the reservoir, the vacuum relief device comprising an enclosed chamber having an air inlet and a liquid inlet, the liquid inlet open to the chamber at a height which is below a height at which the air inlet is open to the chamber, the air inlet in communication with atmospheric air at atmospheric pressure such that the chamber is at atmospheric pressure, the liquid inlet connected by via a liquid passageway with liquid in the reservoir, the liquid inlet at a height below a height of liquid in the reservoir such that when pressure in the reservoir is atmospheric pressure, due to gravity the liquid from the reservoir fills the liquid passageway and, via the liquid passageway, fills the chamber to a height above the height of the liquid inlet and below the height of the air inlet, and wherein on dispensing liquid from the reservoir outlet increasing vacuum below atmospheric in the reservoir, the height of liquid in the chamber decreases until the height of liquid is below the height of the liquid inlet and the liquid inlet is open to air in the chamber such that air in the chamber attempts to flow under gravity upward through the liquid passageway to the reservoir to decrease vacuum in the reservoir, the one-way valve disposed across the liquid passageway between the liquid inlet and the reservoir movable between a closed position preventing flow between the reservoir and the liquid inlet and an open position permitting flow between the reservoir and the liquid inlet.

2. A combination as claimed in claim 1 wherein the valve assuming the closed position when the pressure in the reservoir is sufficiently below atmospheric pressure.

3. A combination as claimed in claim 2 wherein the valve includes a resilient member having an inherent bias biasing the valve to assume the closed position.

4. A combination as claimed in claim 2 wherein the reservoir is a rigid non-collapsible container.

5. A combination as claimed in claim 2 wherein the chamber is defined within a vessel having side walls, a top wall and a bottom wall, an air passageway is defined within an air tube extending from an opening in the bottom wall upwardly within the chamber towards the top wall to an upper end of the air tube which comprises the air inlet, the liquid passageway is defined within a liquid tube extending from an opening in the top wall downwardly within the chamber towards the bottom wall to a lower end of the liquid tube which comprises the liquid inlet, the one-way valve disposed across the opening in the top wall.

6. A combination as claimed in claim 2 wherein the vacuum relief device includes a vessel having side walls, a top wall and a bottom wall, a holding tube extending from the bottom wall upwardly within the vessel towards the top wall to an upper end of the holding tube which comprises the air inlet, the holding tube defining the chamber therein, an air passage between the holding tube and the side walls extending from the bottom wall to the top wall, an opening open to atmosphere at a height below the air inlet through the bottom wall or the side wall into the air passage between the holding tube and the side walls, the liquid passageway defined within a liquid tube extending from an opening in the top wall downwardly within the chamber towards the bottom wall into the holding tube to a lower end of the liquid tube which comprises the liquid inlet with a transfer passage between the holding tube and liquid tube for fluid passage between the air inlet and the liquid inlet, the one-way valve disposed across the opening in the top wall.

7. A combination as claimed in claim 6 wherein a base element comprises the bottom wall and the holding tube, a cap element comprises the top wall and liquid tube, the cap element and base element coupled together to form the vessel, the one-way valve comprising: a male valve seat member carried by the base element extending upwardly therefrom into the liquid tube, and an annular female valve seat member carried by the cap element within the liquid tube, the female valve seat member being biased to move downwardly into sealed engagement with the male element in the closed position of the one-way valve and to move to be spaced upwardly from the male element in the open position of the one-way valve.

8. A combination as claimed in claim 7 wherein the liquid tube is movable with the female valve seat member.

9. A combination as claimed in claim 8 wherein the liquid tube is coaxially located within the holding tube with the transfer passage comprising an annular passage radially there between, the male valve seat member and female valve seal member coaxially within the liquid tube.

10. A combination as claimed in claim 9 wherein the holding tube is coaxially located within the side walls with the air passage comprising an annular passage radially there between.

11. A combination as claimed in claim 3 wherein the resilient member has a tendency to lose its resiliency resulting in a reduction of the inherent bias that biases the valve to assume the closed position.

12. A combination as claimed in claim 11 wherein the event of failure of the one-way valve such that the one-way valve does not prevent fluid flow between the reservoir and the liquid inlet, flow from the reservoir to the liquid inlet is controlled by the vacuum relief device.

13. A combination as claimed in claim 3 wherein the resilient member is an elastomeric member which on exposure over time to the liquid to be dispensed has a tendency to lose its resiliency resulting in a reduction of the inherent bias that biases the valve to assume the closed position.

14. A combination as claimed in claim 13 wherein when the reduction of the inherent bias of the resilient member is such that the one-way valve does not prevent fluid flow between the reservoir and the liquid outlet.

15. A liquid dispenser comprising:

an enclosed non-collapsible container enclosed but for having at one end of the container a neck open at a container outlet opening, a dispensing plug received in the container outlet opening comprising a piston chamber forming element defining an outwardly opening cylindrical chamber with a piston member slidably received therein for reciprocal sliding to dispense liquid from the container and in dispensing liquid create a vacuum within the container, a vacuum relief device carried on the dispensing plug adapted to permit atmospheric air to enter the container to reduce any vacuum developed in the container, the vacuum relief device comprising an enclosed chamber having an air inlet and a liquid inlet, the liquid inlet open to the chamber at a height, which is below a height at which the air inlet is open to the chamber, the air inlet in communication through the dispensing plug with air at atmospheric pressure such that the chamber is at atmospheric pressure, the liquid inlet connected by via a liquid passageway with liquid in the container, the liquid inlet at a height below a height of liquid in the container such that when pressure in the container is atmospheric pressure, due to gravity the liquid from the container fills the liquid passageway and, via the liquid passageway, fills the chamber to a height above the height of the liquid inlet and below the height of the air inlet, and wherein on dispensing liquid from the container increases vacuum below atmospheric in the container, the height of liquid in the chamber decreases until the height of liquid is below the height of the liquid inlet and the liquid inlet is open to air in the chamber such that air in the chamber attempts to flow under gravity upward through the liquid passageway to the container to decrease vacuum in the reservoir, a one-way valve disposed across the liquid passageway between the liquid inlet and the container movable between a closed position preventing flow between the container and the liquid inlet and an open position permitting how between the container and the liquid inlet.

16. A liquid dispenser as claimed in claim 15 wherein the piston forming element having axially inwardly of the piston chamber a vessel having a bottom wall, a cylindrical side wall and a top wall, a holding tube extending from the bottom wall upwardly within the vessel towards the top wall to an upper end of the holding tube which comprises the air inlet, the holding tube defining the chamber therein, an air passage between the holding tube and the side wall extending from the bottom wall to the top wall, an opening open to atmosphere at a height below the air inlet through the bottom wall or the side wall into the air passage between the holding tube and the side walls, the liquid passageway defined within a liquid tube extending from an opening in the top wall downwardly within the chamber towards the bottom wall into the holding tube to a lower end of the liquid tube which comprises the liquid inlet with a transfer passage between the holding tube and liquid tube for fluid passage formed between the air inlet and the liquid inlet;

the one-way valve disposed across the opening in the top wall.

17. A mechanism as claimed in claim 15 wherein a base element comprises the bottom wall and the holding tube, a cap element comprises the top wall and liquid tube, the cap element and base element coupled together to form the vessel, the one-way valve comprising: a male valve seat member carried by the base element extending upwardly therefrom into the liquid tube, and an annular female valve seat member carried by the cap element within the liquid tube, the female valve seat member being biased to move downwardly into sealed engagement with the male valve seat member in the closed position of the one-way valve and to move to be spaced upwardly from the male valve seat member in the open position of the one-way valve.

18. A mechanism as claimed in claim 17 wherein the liquid tube is coaxially located within the holding tube with the transfer passage comprising an annular passage radially there between, the male valve seat member and female valve seal member coaxially within the liquid tube.

19. A combination as claimed in claim 18 wherein the holding tube is coaxially located within the side walls with the air passage comprising an annular passage radially there between.

20. A combination as claimed in claim 19 wherein the resilient member is an elastomeric member which on exposure over time to the liquid to be dispensed has a tendency to lose its resiliency resulting in a reduction of the inherent bias that biases the valve to assume the closed position, wherein if the reduction of the inherent bias of the resilient member is such that the one-way valve does not prevent fluid flow between the reservoir and the liquid outlet, flow from the reservoir out the liquid outlet is merely controlled by the vacuum relief device.

* * * * *